US009470997B2

(12) United States Patent
Coyle et al.

(10) Patent No.: US 9,470,997 B2
(45) Date of Patent: Oct. 18, 2016

(54) STABLE EMISSIVE TONER COMPOSITION SYSTEM AND METHOD

(71) Applicant: Angstrom Technologies, Inc., Florence, KY (US)

(72) Inventors: William J. Coyle, Lebanon, OH (US); Anthony Stramondo, Jupiter, FL (US)

(73) Assignee: Angstrom Technologies, Inc., Florence, KY (US)

( * ) Notice: Subject to any disclaimer, the term of this patent is extended or adjusted under 35 U.S.C. 154(b) by 0 days.

(21) Appl. No.: 14/822,525

(22) Filed: Aug. 10, 2015

(65) Prior Publication Data

US 2015/0355564 A1 Dec. 10, 2015

Related U.S. Application Data

(60) Continuation of application No. 14/027,833, filed on Sep. 16, 2013, now Pat. No. 9,104,126, which is a division of application No. 12/194,939, filed on Aug. 20, 2008, now Pat. No. 8,535,865.

(60) Provisional application No. 60/957,161, filed on Aug. 21, 2007.

(51) Int. Cl.
*G03G 9/16* (2006.01)
*G03G 9/08* (2006.01)
(Continued)

(52) U.S. Cl.
CPC ..... *G03G 9/16* (2013.01); *G03G 9/0821* (2013.01); *G03G 9/0926* (2013.01); *G03G 9/09733* (2013.01)

(58) Field of Classification Search
CPC ..... G03G 9/0821; G03G 9/0926; G03G 9/09766; G03G 9/16
USPC ..... 430/137.1
See application file for complete search history.

(56) References Cited

U.S. PATENT DOCUMENTS 4,865,937 A 9/1989 Santilli et al.
5,049,467 A 9/1991 Yamanaka
(Continued)

FOREIGN PATENT DOCUMENTS

EP 1653292 5/2006
JP 53-037026 4/1978
(Continued)

OTHER PUBLICATIONS

English translation of JP 2006163300 A, Kazuhiko, Jun. 2006, Japan.*
(Continued)

*Primary Examiner* — Peter Vajda
*Assistant Examiner* — Rashid Alam
(74) *Attorney, Agent, or Firm* — Downs Rachlin Martin PLLC

(57) ABSTRACT

A method of producing an emissive toner composition including selecting a photoluminescent agent, a charge control agent, and one or more additives and combining the photoluminescent agent, charge control agent, and one or more additives to form an emissive toner composition that when printed to produce an image component on a substrate, the emission spectra of the image component for irradiation with a first excitation energy includes only dominant emission peaks corresponding to one or more dominant emission peaks of the photoluminescent agent. The photoluminescent agent is selected such that it emits light having one or more dominant emission peaks in a first emission spectral region when irradiated with the first excitation energy. The charge control agent and one or more additives are selected such that they do not emit light in the visible spectrum when irradiated with visible light and does not emit light in the first emission spectral region when irradiated with the first excitation energy.

18 Claims, 17 Drawing Sheets

(51) Int. Cl.

| | |
|---|---|
| ***G03G 9/09*** | (2006.01) |
| ***G03G 9/097*** | (2006.01) |

(56) References Cited

U.S. PATENT DOCUMENTS

| | | | |
|---|---|---|---|
| 5,112,759 | A | 5/1992 | Senoo et al. |
| 5,145,518 | A | 9/1992 | Winnik et al. |
| 5,204,208 | A | 4/1993 | Paine et al. |
| 5,225,900 | A | 7/1993 | Wright |
| 5,256,193 | A | 10/1993 | Winnik et al. |
| 5,286,286 | A | 2/1994 | Winnik et al. |
| 5,318,883 | A | 6/1994 | Yamanaka et al. |
| 5,407,774 | A | 4/1995 | Matsushima et al. |
| 5,413,037 | A | 5/1995 | Auslander et al. |
| 5,414,258 | A | 5/1995 | Liang |
| 5,418,855 | A | 5/1995 | Liang et al. |
| 5,501,934 | A | 3/1996 | Sukata et al. |
| 5,542,971 | A | 8/1996 | Auslander et al. |
| 5,554,842 | A | 9/1996 | Connell et al. |
| 5,574,790 | A | 11/1996 | Liang et al. |
| 5,605,738 | A | 2/1997 | McGinness et al. |
| 5,684,069 | A | 11/1997 | Auslander |
| 5,714,291 | A | 2/1998 | Marinello et al. |
| 5,719,948 | A | 2/1998 | Liang |
| 5,736,289 | A | 4/1998 | Sukata et al. |
| 5,755,860 | A | 5/1998 | Zhu |
| 5,763,891 | A | 6/1998 | Yoshinaga et al. |
| 5,767,980 | A | 6/1998 | Wang et al. |
| 5,837,042 | A | 11/1998 | Lent et al. |
| 5,862,218 | A | 1/1999 | Steinberg |
| 5,880,062 | A | 3/1999 | Sanders et al. |
| 5,952,145 | A | 9/1999 | Yamanaka et al. |
| 5,990,197 | A | 11/1999 | Escano et al. |
| 6,104,812 | A | 8/2000 | Koltai et al. |
| 6,106,110 | A | 8/2000 | Gundjuan et al. |
| 6,140,267 | A | 10/2000 | Gundjian |
| 6,149,719 | A | 11/2000 | Houle |
| 6,303,929 | B1 | 10/2001 | Oshima et al. |
| 6,326,113 | B1 | 12/2001 | Okuda et al. |
| 6,373,965 | B1 | 4/2002 | Liang |
| 6,378,976 | B1 | 4/2002 | Byers et al. |
| 6,400,386 | B1 | 6/2002 | No |
| 6,576,155 | B1 | 6/2003 | Barbera-Guillem |
| 6,603,871 | B2 | 8/2003 | Liang |
| 6,621,916 | B1 | 9/2003 | Smith et al. |
| 6,633,370 | B2 | 10/2003 | Lawandy |
| 6,666,991 | B1 | 12/2003 | Atarashi et al. |
| 6,718,046 | B2 | 4/2004 | Reed et al. |
| 6,991,884 | B2 | 1/2006 | Sun et al. |
| 7,079,230 | B1 | 7/2006 | McInerney et al. |
| 7,821,675 | B2 | 10/2010 | Coyle et al. |
| 2002/0023218 | A1 | 2/2002 | Lawandy et al. |
| 2002/0178951 | A1 | 12/2002 | Lutz et al. |
| 2003/0006170 | A1 | 1/2003 | Lawandy |
| 2003/0025925 | A1 | 2/2003 | Elsman et al. |
| 2003/0041774 | A1 | 3/2003 | Auslander et al. |
| 2003/0072015 | A1 | 4/2003 | Fujino |
| 2003/0112423 | A1 | 6/2003 | Vig et al. |
| 2004/0023397 | A1 | 2/2004 | Vig et al. |
| 2004/0071366 | A1 | 4/2004 | Zhang et al. |
| 2004/0151371 | A1 | 8/2004 | Chen et al. |
| 2004/0169847 | A1 | 9/2004 | Dukler |
| 2004/0233465 | A1 | 11/2004 | Coyle et al. |
| 2005/0019603 | A1 | 1/2005 | Kathirgamanathan |
| 2005/0074684 | A1* | 4/2005 | Yabuki ..... C09B 31/147 430/108.23 |
| 2005/0179252 | A1 | 8/2005 | Alasia et al. |
| 2005/0243305 | A1 | 11/2005 | Vig et al. |
| 2005/0277037 | A1 | 12/2005 | Tokarski et al. |
| 2005/0277039 | A1 | 12/2005 | Lygaitis et al. |
| 2006/0011730 | A1 | 1/2006 | Bi et al. |
| 2006/0024599 | A1 | 2/2006 | Jubran et al. |
| 2007/0114494 | A1 | 5/2007 | Cole et al. |
| 2007/0186804 | A1 | 8/2007 | Heckmann et al. |
| 2008/0261141 | A1 | 10/2008 | Yasukawa et al. |
| 2009/0059252 | A1 | 3/2009 | Coyle et al. |
| 2009/0214972 | A1* | 8/2009 | Wosnick ..... G03G 9/0926 430/108.2 |
| 2011/0101240 | A1 | 5/2011 | Barbera-Guillem |
| 2011/0267656 | A1 | 11/2011 | Coyle |
| 2013/0027723 | A1 | 1/2013 | Coyle |
| 2014/0038101 | A1 | 2/2014 | Coyle et al. |

FOREIGN PATENT DOCUMENTS

| | | | |
|---|---|---|---|
| JP | S62-112659 | | 5/1987 |
| JP | 01-201677 | | 8/1989 |
| JP | 01-259374 | | 10/1989 |
| JP | H02-113074 | | 4/1990 |
| JP | 04-295862 | | 10/1992 |
| JP | 5281786 | | 10/1993 |
| JP | 9101628 | | 4/1997 |
| JP | 2000347461 | | 12/2000 |
| JP | 2002-003835 | | 1/2002 |
| JP | 2002-296845 | | 10/2002 |
| JP | 2002-351216 | | 12/2002 |
| JP | 2003-107803 | | 4/2003 |
| JP | 2004138727 | A | 5/2004 |
| JP | 2005-221891 | | 8/2005 |
| JP | 2005-256220 | | 9/2005 |
| JP | 2006003748 | | 1/2006 |
| JP | 2006163300 | | 6/2006 |
| JP | 2006163300 | A * | 6/2006 |
| JP | 2007017719 | | 1/2007 |
| JP | 2007206262 | A | 8/2007 |
| WO | 9120156 | | 12/1991 |
| WO | WO0106453 | | 1/2001 |

OTHER PUBLICATIONS

"Principles of Fluorescence Spectroscopy," Second Edition, by LAKOWICZ, Joseph R., Kluwer Academic/Plenum Publishers, New York, 1999, pp. 7-8.

International Search Report and Written Opinion mailed Feb. 12, 2009, in International Patent Application No. PCT/US2008/073711 filed Aug. 20, 2008.

European Search Report dated Oct. 12, 2011, in corresponding EU Application No. 08798272.4 filed in the name of Angstrom Technologies, Inc.

Office Action dated Jan. 16, 2013 (translated) in JP Patent Application No. 2010-521996.

Wang Ya, Li JJ, Chen H, and Peng X: Stabilization of Inorganic Nanocrystals by Organic Dendrons. J. Am. Chem. Soc., vol. 124, No. 10, 2293-2298, 2002.

Gerion D, Pinaud F, William SC, Parak WJ, Zanchet D, Weiss S., and Alivisatos AP: Synthesis and Properties of Biocompatible Water-Soluable Silica-Coated CdSe/Zns Semiconductor Quantom Dots. J. Phys. Chem. B 2001, 105, 8861-8871.

Alivisatos AP: Semiconductor Clusters, Nanocrystals, and Quantum Dots. Science, vol. 271, 933-937, Feb. 16, 1996.

Hines MA and Guyot-Sionnest P: Synthesis and Characterization of Strongly Luminescing ZnS-Capped CdSe Nanocrystals. J. Phys. Chem. 1996, 100, 468-471.

Micic OI, Sprague JR, Curtis CJ, Jones KM, Machol JL, Nozik AJ, Giessen H, Fluegel B, Mohs G and Peyghambarian N: Synthesis and Characterization of InP, GaP, GaInP2, Quantum Dots. J. Phys. Chem. 1995, 99, 7754-7759.

Murray CB, Norris DJ, and Bawendi MG: Synthesis and Characterization of nearly Monodisperse CdE (E=S, Se, Te) Semiconductor Nanocrystals. J. Am. Chem. Soc. 1993, 115, 8706-8715.

Reynolds GA and Drexhage KH: Stable Heptamethine Pyrylium Dyes That Absorb in the Infrared. J. Org. Chem., vol. 42, No. 5, 885-888, 1977.

World Wide Web URL, http://www.efg2.com/lab/graphics/colors/chromaticity.htm.

(56) References Cited

OTHER PUBLICATIONS

Synthesis of Luminescent Organic/Inorganic Polymer Nanocomposites. Steven C. Farmer and Timothy E. Patten, Polymeric Materials Science and Engineering, V. 82 (2000), pp. 237-238.
Restriction Requirement dated Mar. 28, 2012, in related U.S. Appl. No. 12/194,939, filed Aug. 20, 2008, in the name of Coyle et al.
Response to Restriction Requirement dated Apr. 3, 2012, in related U.S. Appl. No. 12/194,939, filed Aug. 20, 2008, in the name of Coyle et al.
Office Action dated Oct. 26, 2012, in related U.S. Appl. No. 12/194,939, filed Aug. 20, 2008, in the name of Coyle et al.
http://www.colorhexa.com/a41e54, ColorHeax, 2012.
http://www.palettebuilder.com/rgb/150/75/0/default.aspx, 2012 PaletteBuilder.com.
Response to Office Action dated Jan. 30, 2013, in related U.S. Appl. No. 12/194,939, filed Aug. 20, 2008, in the name of Coyle et al.
Notice of Allowance dated Jul. 19, 2013, in related U.S. Appl. No. 12/194,939, filed Aug. 20, 2008, in the name of Coyle et al.
Decision of Rejection dated Oct. 9, 2013, in related Japan Patent Application No. 2010-521996.
First Office Action reported in letter of Aug. 14, 2013, in related Israel Patent Application No. 204027.
Office Action dated May 22, 2015, in related European Patent Application No. 08798272.4.
Office Action dated Oct. 7, 2014, in parent U.S. Appl. No. 14/027,833, filed Sep. 16, 2013.
Notice of Allowance May 11, 2015, in parent U.S. Appl. No. 14/027,833, filed Sep. 16, 2013.

* cited by examiner

STABLE EMISSIVE TONER COMPOSITION SYSTEM AND METHOD

RELATED APPLICATION DATA

This application is a continuation of U.S. patent application Ser. No. 14/027,833, entitled "Stable Emissive Toner Composition System and Method," now allowed, which application is a divisional of U.S. patent application Ser. No. 12/194,939, filed Aug. 20, 2008, entitled "Stable Emissive Toner Composition System and Method," now U.S. Pat. No. 8,535,865, which application claims the benefit of priority of U.S. Provisional Patent Application Ser. No. 60/957,161, filed Aug. 21, 2007, entitled "Stable Emissive Toner Composition For Marking and Authentication." Each of these applications is incorporated by reference herein in its entirety.

This application is related to U.S. application Ser. No. 10/818,058, entitled "Methods and Ink Compositions for Invisibly Printed Security Images Having Multiple Authentication Features," filed on Apr. 5, 2004, now U.S. Pat. No. 7,821,675, which is incorporated herein by reference in its entirety.

FIELD OF THE INVENTION

The present invention generally relates to the field of marking and authentication of documents and other items. In particular, the present invention is directed to a stable emissive toner composition for marking and authentication.

BACKGROUND

Typically, printing on a substrate is performed with reflective inks and/or toners using, for example, an ink-jet or laser printer, respectively. In toner systems, reflective colors are produced by the reflection of light of one or more wavelengths by toner printed on a substrate. Multiple color reflective toners may be applied to a substrate in differing amounts to produce a variety of reflective colors. The colors reflected are determined by the electromagnetic energy (i.e., light) that the toner on the substrate absorbs or otherwise subtracts from the light incident on the toner. The subtractive primary colors commonly used in reflective color printing are cyan, yellow, and magenta. Such a printing system is referred to as a CYMK model. In printing with component C, Y, and M reflective toner compositions, colors of hues other than cyan, yellow, and magenta can be produced by combining the subtractive primary colors in differing amounts on the substrate to combine the absorption of each primary color. The incident light not absorbed is reflected to produce reflected light of a particular color. For example, a reflective cyan toner composition absorbs certain wavelengths of incident visible light and reflects the non-absorbed remaining visible light having wavelengths corresponding to the color cyan. In another example, a reflective yellow toner composition absorbs certain wavelengths of incident visible light and reflects the non-absorbed remaining visible light having wavelengths corresponding to the color yellow. Combining the subtractive absorption of a reflective yellow toner and a reflective cyan toner can produce a reflective light having wavelengths corresponding to a green color. Combination of colors (e.g., inks, toners) in printing may occur by a variety of known processes including, but not limited to, stochastic screening, traditional line screening, half-toning, dithering, pixelation, and any combinations thereof.

In reflective printing using cyan, yellow, and magenta reflective toner compositions, the C, Y, and M image components may be combined to produce the absorption of substantially all visible wavelengths and reflecting a black color. Alternatively, a CYMK model (where the "K" represents the "key") may include a fourth reflective black toner composition as the key for producing reflective black color in printing.

Another color model, the RGB model, is based on additive properties of the colors red (R), green (G), and blue (B), from which many colors and hues may be produced. The CYMK and RGB models have been correlated by known processes in traditional reflective printing (e.g., in digital computer printing processes utilizing software correlations and/or conversions).

SUMMARY OF THE DISCLOSURE

In one embodiment, the present disclosure is directed to an emissive toner composition for marking an article with an image indicia for authentication, information, or decoration. The composition includes a photoluminescent agent that emits light having one or more dominant emission peaks in a first emission spectral region, each of the one or more dominant emission peaks centered at a corresponding emission wavelength, when irradiated with a first excitation energy; a charge control agent that is chemically compatible with the photoluminescent agent and that does not emit light in the visible spectrum when irradiated with visible light and does not emit light in the first emission spectral region when irradiated with the first excitation energy; one or more additives that are compatible with the photoluminescent agent and the charge control agent and that do not emit light in the visible spectrum when irradiated with visible light and do not emit light in the first emission spectral region when irradiated with the first excitation energy; and the photoluminescent agent, the charge control agent, and the one or more additives to form an emissive toner composition that, when printed to produce an image component on a substrate, has, when irradiated with the first excitation energy, an emission spectra that includes only dominant emission peaks corresponding to the one or more dominant emission peaks of the photoluminescent agent.

In another embodiment, the present disclosure is directed to an emissive toner composition for marking an article with an image indicia for authentication, information, or decoration. The composition includes a photoluminescent agent that emits light having one or more dominant emission peaks in a first emission spectral region, each of the one or more dominant emission peaks centered at a corresponding emission wavelength, when irradiated with a first excitation energy, the photoluminescent agent not emitting light in the visible spectrum when irradiated with visible light; a charge control agent that is chemically compatible with the photoluminescent agent and that does not emit light in the visible spectrum when irradiated with visible light and does not emit light in the first emission spectral region when irradiated with the first excitation energy, the charge control agent being present in a charge control effective amount and the charge control effective amount being reflectively invisible; one or more additives that are compatible with the photoluminescent agent and the charge control agent and that do not emit light in the visible spectrum when irradiated with visible light and do not emit light in the first emission spectral region when irradiated with the first excitation energy; and the photoluminescent agent, the charge control agent, and the one or more additives to form an emissive toner composition that, when printed to produce an image component on a substrate, has, when irradiated with the first excitation energy, an emission spectra that includes only dominant emission peaks corresponding to the one or more dominant emission peaks of the photoluminescent agent.

In yet another embodiment, the present disclosure is directed to an emissive toner composition for producing an emissive image component of an image indicia on a substrate. The composition includes a photoluminescent agent that emits light having one or more emission peaks in a first emission spectral region, each of said one or more emission peaks centered at a corresponding emission wavelength, when irradiated with a first excitation energy; a charge control agent; and one or more additives, said photoluminescent agent, charge control agent, and one or more additives being selected and present in an amount in the toner composition such that when the toner composition is printed to produce an image component on a substrate, the emission spectra of the image component for irradiation with said first excitation energy includes only dominant emission peaks in said first emission spectral region corresponding to said one or more emission peaks of said photoluminescent agent, wherein when the toner composition is printed to produce an image component on a substrate, the image component has a photoluminescent toner stability factor of about greater than or equal to 25, wherein the photoluminescent toner stability factor is calculated according to the following equation:

$$PTSF=((1-ALF\text{-}XE)\times ALF\text{-}QUV)\times 100,$$

where PTSF is the photoluminescent toner stability factor, ALF-XE is the average loss in photoluminescence of said image component from day 3 to day 7 of a seven day xenon-arc exposure at 0.35 $W/m^2$ at 340 nm with said image component distanced from said xenon arc exposure at 10 inches and a temperature of 50 degrees Celsius, ALF-QUV is the average loss in photoluminescence of said image component from day 3 to day 7 of submission of said image component to QUV exposure conditions.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
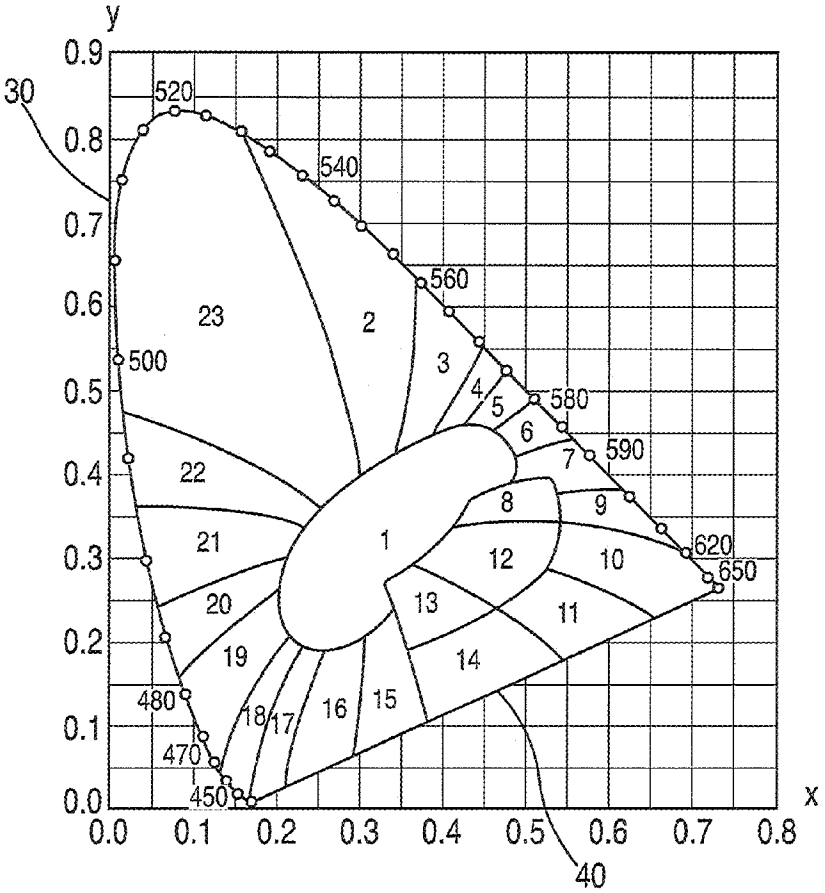
FIG. 1 illustrates one example of a conventional CIE 1931 chromaticity diagram.

An emissive toner composition, system, and method are described herein that provide stable marking on a substrate. In one exemplary aspect, a stable emissive toner may allow printing of an image component on a substrate where the image component emits, as opposed to reflecting, one or more wavelengths of energy. A plurality of image components may be combined to provide a multiple color (e.g., a full-color) image produced by the emitted energy.

Emissive printing differs greatly from reflective printing. One important difference is that emissive printing involves radiation of electromagnetic energy from a chemical compound (e.g., a chemical compound in an emissive toner composition). This radiation is caused by the chemical compound changing from a higher electronic energy state (e.g., initiated by irradiating the chemical compound with an energy) to a lower electronic energy state. Such radiation may be referred to as photoluminescence. Photoluminescence is a process in which a chemical compound absorbs photons (electromagnetic radiation), jumping to a higher electronic energy state, and then radiates photons back out, returning to a lower energy state. Examples of photoluminescence include, but are not limited to, resonant radiation, fluorescence, phosphorescence, and any combinations thereof. In one example, an emissive toner composition may have luminescence that includes fluorescence. In another example, an emissive toner composition may have luminescence that includes phosphorescence.

Energy emitted by an emissive toner composition may occur at one or more wavelengths. As discussed further below, the emitted energy may occur in one or more spectral regions. Unlike reflective printing techniques, an emissive toner composition may emit energy at a wavelength and/or in a spectral region that is different from energy incident the emissive toner. For example, a visible image can be produced from one or more emissive toner compositions printed on a substrate even though no visible light is present in the ambient environment.

In one implementation, an emissive toner composition includes one or more photoluminescent compounds that emit energy having one or more wavelengths upon irradiation with excitation energy, a charge control agent, and one or more additives. With the proper selection of emissive toner composition constituents, it is possible to produce toner compositions that have a high level of stability as described further herein. Reflective toner compositions and issues related thereto are not interchangeable for emissive toner compositions and the requirements thereof. It has been found that the proper selection of emissive toner composition constituents and the amount of each constituent impacts the stability of the resultant emissive image component. Ink jet systems also differ greatly from toner based systems, which have complex physical and chemical requirements and demands that are not compatible with ink jet concepts. An example of an emissive ink jet system is disclosed in U.S. patent application Ser. No. 10/818,058 to Coyle et al., which is incorporated herein by reference in its entirety. Examples of an emissive toner composition according to the present disclosure address examples of such complex requirements and demands. In one exemplary aspect, an emissive toner composition provides an improved stability. As far as is known to the Applicants, such an emissive toner composition may be utilized to produce an image component on a substrate and a plurality of such emissive toner compositions may be utilized to produce a full-color image on a substrate that have color and/or stability properties heretofore not possible from prior art toner systems.

FIG. 1 illustrates an example of a conventional CIE 1931 chromaticity diagram illustrating approximate color space regions generally identified with some common names of color hues as listed in TABLE 1. TABLE 1 shows the hue designations and the reference numeral corresponding to each hue. FIG. 1 is based on the article by Kenneth L. Kelly, "Color Designations for Lights," Journal of the Optical Society of America, vol. 33 (1943) pp. 627-632.

TABLE 1

Reference Numerals Corresponding to Hues in FIG. 1

| Reference numeral | Hue |
|---|---|
| 1 | Illuminant Area |
| 2 | Yellowish Green |
| 3 | Yellow-Green |
| 4 | Greenish Yellow |
| 5 | Yellow |
| 6 | Yellowish Orange |
| 7 | Orange |
| 8 | Orange Pink |
| 9 | Reddish Orange |
| 10 | Red |
| 11 | Purplish Red |
| 12 | Pink |
| 13 | Purplish Pink |
| 14 | Red Purple |
| 15 | Reddish Purple |
| 16 | Purple |
| 17 | Bluish Purple |
| 18 | Purplish Blue |
| 19 | Blue |
| 20 | Greenish Blue |

TABLE 1-continued

Reference Numerals Corresponding to Hues in FIG. 1

| Reference numeral | Hue |
|---|---|
| 21 | Blue-Green |
| 22 | Bluish Green |
| 23 | Green |

It will be understood that the boundaries in FIG. 1 that delineate named hue regions are somewhat arbitrary, and are for exemplary qualitative approximation of where various hues are located in the continuous visual color space represented by the chromaticity diagram, without reproducing the chromaticity diagram in color. Full color reproductions of a CIE 1931 chromaticity diagram are readily available in many published references on color theory and colorimetry, including the World Wide Web URL, http://www.efg2.com/Lab/Graphics/Colors/Chromaticity.htm.

The CIE 1931 chromaticity diagram of FIG. 1 includes a horseshoe shaped line 30 representing a spectral locus. Wavelengths in nm are shown around the edge of shaped line 30. A straight line 40 connects the endpoints of the horseshoe curve and is known as a non-spectral "line of purples." Coordinates x and y measured along the abscissa and ordinate axes, respectively, are related to tristimulus values X, Y, and Z by the relationships $x=X/(X+Y+Z)$; $y=Y/(X+Y+Z)$; $z=Z/(X+Y+Z)$; and $x+y+z=1$.

As stated above, a plurality of emissive toner compositions may be utilized to produce an image on a substrate that has a plurality of image components that combine to form an emissively detectible image. In one example, such emission may include light in a visible spectral region that produces a full-color image. The term "full-color" refers in this context to an image that contains visible emissive colors that are created by the combination of emissions from multiple emissive image components. In another example, an image produced by a plurality of emissive toner compositions includes emissive colors from as wide a range of colors as possible. In yet another example, an image produced by a plurality of emissive toner compositions includes emissive colors from a wide range of colors from a color space defined by a CIE 1931 chromaticity diagram, such as the CIE 1931 chromaticity diagram of FIG. 1.

Figure 2:
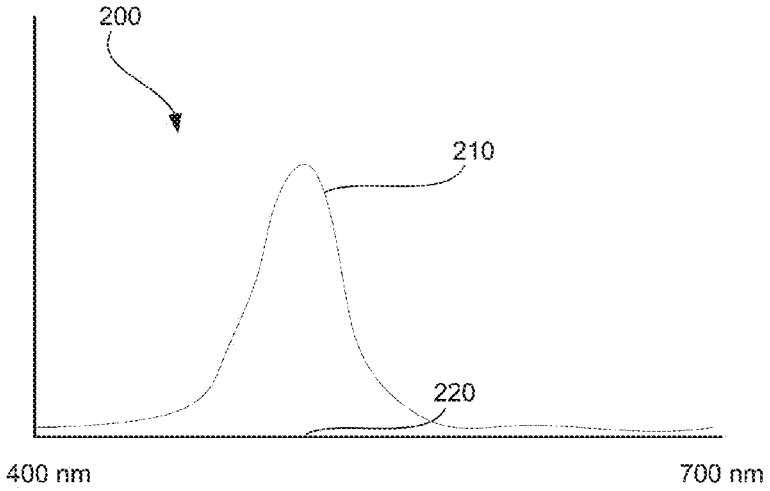
FIG. 2 illustrates one example of an emission spectra for an exemplary photoluminescent agent.
Figure 3:
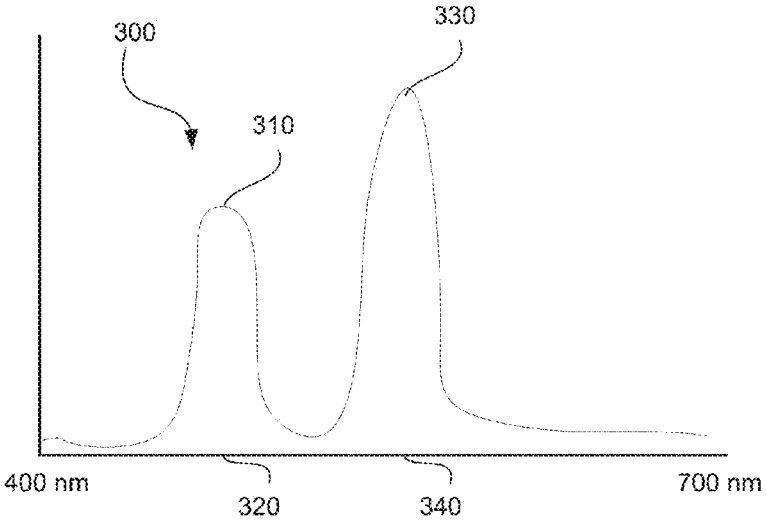
FIG. 3 illustrates one example of an emission spectra for another exemplary photoluminescent agent.

As will be discussed further below, a photoluminescent agent is selected in combination with a charge control agent and one or more additives to provide a toner composition having one or more desired characteristics related to visibility and/or stability. A photoluminescent agent emits light having one or more emission peaks in a desired spectral region when irradiated with an excitation energy. Spectral regions for emission and excitation energy are discussed further below. FIG. 2 illustrates one example of an emission spectra 200 for an exemplary photoluminescent agent having a single emission peak 210 centered at a wavelength 220. FIG. 3 illustrates another example of an emission spectra 300 for an exemplary photoluminescent agent having a emission peak 310 centered at a wavelength 320 and a emission peak 330 centered at a wavelength 340. Emission peak 330 is an example of an emission maximum peak.

An emission maximum peak is an emission peak in a given emissive spectral region having the greatest intensity of emission of all emission peaks in that emissive spectral region. A dominant emission peak is an emission peak in an emissive spectral region that has a relative intensity of emission that exceeds a 5 percent (%) of the intensity of emission for the emission maximum peak having the highest intensity of emission in that emissive spectral region. It should be noted that exceeding a certain threshold includes being greater than and/or greater than or equal to the threshold value given. In one example, a dominant emission peak is any peak in the chosen emissive spectral region including the emission peak having the greatest intensity of emission and any other emission peak having an intensity that exceeds 5 percent (%) of the intensity of the emission maximum peak.

A photoluminescent agent may have one or more emission peaks each centered at a wavelength in a spectral region. Example spectral regions of emission include, but are not limited to, a visible spectral region (e.g., wavelengths of about 400 nm to about 700 nm), an ultraviolet (UV) spectral region (e.g., wavelengths of about 200 nm to about 400 nm), an infrared (IR) spectral region (e.g., wavelengths of about 700 nm to about 1500 nm for near IR, wavelengths of about 1500 nm to about 11,000 nm for far IR), a short-wave UV spectral region (e.g., wavelengths of about 200 nm to about 300 nm), a long-wave UV spectral region (e.g., wavelengths of about 300 nm to about 400 nm), and any combinations thereof. In one example, a photoluminescent agent is chosen to have an emission maxima in a desired authentication emission spectral region. For discussion purposes herein, the spectral region of emission of a photoluminescent agent of an emissive toner composition may be referred to as a desired authentication emission spectral region and the spectral region of excitation energy utilized to provide the desired emission may be referred to as a desired authentication excitation spectral region. It should be noted that non-authentication applications of an emissive toner composition are contemplated as being included in these spectral region references.

Excitation energy may include energy at one or more wavelengths from a variety of spectral regions. In one example, excitation energy includes a narrow band of wavelengths of energy. In another example, excitation energy includes a broad band of wavelengths of energy. In still another example, excitation energy includes a discrete wavelength of energy. Example spectral regions of excitation include, but are not limited to, a visible spectral region, a UV spectral region, an IR spectral region (near and/or far), and any combinations thereof. In one example, a photoluminescent agent emits in a visible spectral region when irradiated with an excitation energy in a UV spectral region. In another example, a photoluminescent agent emits in a UV spectral region when irradiated with an excitation energy in a UV spectral region. In yet another example, a photoluminescent agent emits in the visible spectral region when irradiated with a short-wave UV excitation energy. In still another example, a photoluminescent agent emits in an IR spectral region when irradiated with an excitation energy in the UV spectral region. In still yet another example, a photoluminescent agent emits in an IR spectral region when irradiated with an excitation energy in the IR spectral region. In a further example, a photoluminescent agent emits in the visible spectral region when irradiated with an excitation energy in the IR spectral region (e.g., an IR upconverting photoluminescent agent). Those skilled in the art will recognize that a variety of combinations of excitation energies and resultant emission energies are possible. Selection of a photoluminescent agent can be made such that the chosen photoluminescent agent has one or more emission peaks centered at wavelengths in a desired spectral region when irradiated with energy of a desired excitation spectral region.

Sources of various excitation energies are known. In one example of a photoluminescent agent having an excitation energy in the UV spectral region, a source for such energy may be a conventional UV source blacklight. As will be recognized by those of ordinary skill, a conventional blacklight may also include irradiated energy in the visible spectral region. In such an example, an image component on a substrate from an emissive toner composition may be subjected to both UV and visible incident light.

As used herein the term visible is used with respect to a spectral region to define a spectral region typically bounded by about 400 nm and about 700 nm. The term visible may also be used to describe a toner composition, or a part thereof, that when printed on a substrate has a reflectivity in the 400-700 nm visible range that is detectible upon inspection with the unaided human eye. An invisible toner composition includes a toner composition that lacks reflectivity in the 400-700 nm visible range that is detectable by the unaided human eye. In one example, an invisible toner composition is a toner composition that when printed allows all light in the 400-700 nm range to pass through to the substrate, which acts on it in a typical reflective fashion to reflect non-absorbed light in the visible spectral region. Such reflected light of the visible spectral region is perceived by the unaided human eye in the same way as reflected light from surrounding background portions of the substrate that do not have invisible toner composition printed thereon. In another example, an invisible toner composition is a toner composition that when printed has a reflective optical density (OD) of about less than 0.03 optical density with respect to the substrate. In yet another example, an invisible toner composition is a toner composition that when printed has a reflective optical density of about less than 0.021 optical density with respect to the substrate. It should be noted that a toner composition when printed on a substrate may impart a sheen that may be detectable by the unaided human eye due to changes in index of refraction between the environment and the toner composition on the substrate. In one exemplary aspect, visibility of a toner composition as used herein does not refer to detectability due solely to index of refraction.

Sheen due to index of refraction differences may be mitigated or eliminated by the use of a lamination technique over the printed toner composition. Various techniques for laminating a substrate are known by those of ordinary skill. In another example, lamination over a printed toner composition may enhance authentication protection by providing a mechanical mechanism by which removal of the lamination may also separate all or part of the printed toner composition from the substrate. In such an example, it may be easily detectible that the lamination was removed from the substrate (e.g., in an attempt to modify the substrate).

An emissively invisible toner composition when printed on a substrate does not emit energy of the visible spectral region when irradiated with excitation energy. An IR reflectionless toner composition when printed on a substrate does not have a reflectivity in the IR spectral region. A UV reflectionless toner composition when printed on a substrate does not have a reflectivity in the UV spectral region.

A photoluminescent agent may include one or more of a variety of characteristics related to emissive and reflective visibility. Such characteristics may be determined by the application of use for an emissive toner composition including the photoluminescent agent. Examples of characteristics related to emissive and reflective visibility include, but are not limited to, a reflectively invisible characteristic, a reflectively visible characteristic, an emissively invisible characteristic, an emissively visible characteristic, and any combinations thereof. In one example, a photoluminescent agent may be reflectively invisible. A reflectively invisible photoluminescent agent, when printed on a substrate, provides no reflective energy in the visible spectrum. In another example, a photoluminescent agent may be reflectively visible. A reflectively visible photoluminescent agent, when printed on a substrate, provides reflective energy at one or more wavelengths in the visible spectrum. In yet another example, a photoluminescent agent may be emissively invisible. An emissively invisible photoluminescent agent, when printed on a substrate, provides no emission of energy that is detectible by the unaided human eye in the visible spectrum when irradiated with an excitation or other energy (e.g., energy in the visible spectrum). In still another example, a photoluminescent agent may be emissively visible. An emissively visible photoluminescent agent, when printed on a substrate, provides emission of one or more wavelengths of energy that is detectible by the unaided human eye in the visible spectrum when irradiated with an excitation or other energy (e.g., energy in the visible spectrum).

A photoluminescent agent may be present in a stable emissive toner composition in an amount that depends at least in part on chosen photoluminescent agent, chosen charge control agent, and other additives such that the toner composition provides desired stability and color characteristics. A photoluminescent agent should be present in at least an amount in an emissive toner composition such that emission therefrom when irradiated with the corresponding excitation energy is emissively detectible (e.g., with an unaided human eye, with an emission detection device, etc.). In one example of a reflectively invisible emissive toner composition, a photoluminescent agent has concentration upper bound in the toner composition that is defined, at least in part, by the amount of photoluminescent agent that would (in combination with other toner composition constituents) cause the toner composition to have a detectible visible reflectivity. In one example of a reflectively visible emissive toner composition, a photoluminescent agent has a concentration upper bound in the toner composition that is defined, at least in part, by the amount of photoluminescent agent that would (in combination with other toner composition constituents) not allow the charge control agent to effectively control the charge of the toner composition during electrostatic printing.

In one embodiment, an amount of a photoluminescent agent in one emissive toner composition of a printing system (e.g., an RGB model printing system, a CYMK model printing system) may be influenced by the amount of one or more other photoluminescent agents in one or more other emissive toner compositions of the printing system. For example, the intensity of emission of one photoluminescent agent in one toner composition may be less per weight percent than in another. In one example, the amount of photoluminescent agent in toner compositions of a plurality of toner compositions in a printing system may be balanced against each other in order to attain a balance in intensity of emission amongst the plurality of toner compositions.

In one example, a photoluminescent agent is present in an emissive toner composition in an amount from about 0.01 weight percent (wt. %) to about 60 wt. %. In another example, a photoluminescent agent is present in an emissive toner composition in an amount from about 4 wt. % to about 45 wt. %. In yet another example, a photoluminescent agent is present in an amount from about 12 wt. % to about 28 wt. %. In still another example, a photoluminescent agent is present in an amount from about 18 wt. % to about 24 wt. %.

In one example of an emissively red color toner composition, an emissively red photoluminescent agent is present in an emissive toner composition in an amount from about 16 wt. % to about 28 wt. %. In another example of an emissively red color toner composition, an emissively red photoluminescent agent is present in an emissive toner composition in an amount of about 22 wt. %.

In one example of an emissively green color toner composition, an emissively green photoluminescent agent is present in an emissive toner composition in an amount from about 12 wt. % to about 24 wt. %. In another example of an emissively green color toner composition, an emissively green photoluminescent agent is present in an emissive toner composition in an amount of about 18 wt. %. In yet another example of an emissively green color toner composition, an emissively green photoluminescent agent is present in an emissive toner composition in an amount from about 4 wt. % to about 8 wt. %. In still another example of an emissively green color toner composition, an emissively green photoluminescent agent is present in an emissive toner composition in an amount of about 6 wt. %.

In one example of an emissively blue color toner composition, an emissively blue photoluminescent agent is present in an emissive toner composition in an amount from about 5 wt. % to about 60 wt. %. In another example of an emissively blue color toner composition, an emissively blue photoluminescent agent is present in an emissive toner composition in an amount from about 20 wt. % to about 60 wt. %. In another example of an emissively blue color toner composition, an emissively blue photoluminescent agent is present in an emissive toner composition in an amount of about 40 wt. %.

In one example of an emissively cyan color toner composition, an emissively cyan photoluminescent agent is present in an emissive toner composition in an amount from about 10 wt. % to about 60 wt. %. In another example of an emissively cyan color toner composition, an emissively cyan photoluminescent agent is present in an emissive toner composition in an amount of about 25 wt. %.

In one example of an emissively yellow color toner composition, an emissively yellow photoluminescent agent is present in an emissive toner composition in an amount from about 2 wt. % to about 6 wt. %. In another example of an emissively yellow color toner composition, an emissively yellow photoluminescent agent is present in an emissive toner composition in an amount of about 4 wt. %.

In one example of an emissively magenta color toner composition, an emissively magenta photoluminescent agent is present in an emissive toner composition in an amount from about 16 wt. % to about 28 wt. %. In another example of an emissively magenta color toner composition, an emissively magenta photoluminescent agent is present in an emissive toner composition in an amount of about 22 wt. %. It is contemplated that in examples throughout the current description where a quantitative value and/or value range is modified by the term "about" that an alternative example for each exists that does not include the "about" modifier.

Other exemplary factors that may be utilized to determine an appropriate photoluminescent agent for an emissive toner composition include, but are not limited to, the stability of the photoluminescent agent itself, the volatility of the photoluminescent agent, the purity of the photoluminescent agent, solubility of the photoluminescent agent itself and any combinations thereof. In one example, the stability of a photoluminescent agent is considered in selecting an appropriate photoluminescent agent. In one such example, a photoluminescent agent having a Blue Wool Scale (and/or ASTM standard D4303-03) value of greater than 3 is selected. In another such example, a photoluminescent agent having a Blue Wool Scale value of greater than 4 is selected. In yet another such example, improved lightfastness is balanced against desired resultant emissive color in selecting a photoluminescent agent.

In another example, the purity of a photoluminescent agent is considered in selecting an appropriate photoluminescent agent. In one such example, if potential impurities of a photoluminescent agent include an emissively quenching substance, removal of the impurities may increase the emissive lightfastness of the resulting emissive toner composition. In another such example, if potential impurities of a photoluminescent agent include an electron transfer agent (e.g., an agent that reduces the efficiency of the excited state of the photoluminescent agent), reduction of the impurities may increase the emissive lightfastness of the resulting emissive toner composition. In yet another such example, if potential impurities of a photoluminescent agent include a non-quenching, UV absorbing species, the presence of such an impurity may shield the photoluminescent agent from the emissive lightfast damaging effects of incident UV energy. Determining the impact of an impurity on a desired characteristic of an emissive toner composition may be performed in a variety of ways. In one exemplary way, a toner composition having the photoluminescent agent with the impurity and a toner composition having the photoluminescent agent with a reduction in the impurity may be prepared and tested for the desired characteristic (e.g., stability, lightfastness). As stated above, the desired purity level may depend on a variety of factors. A photoluminescent agent may have a purity that allows for desired toner characteristics (e.g., stability, emissive color output, etc.). In one example, a photoluminescent agent has a purity of at least about 95%. In another example, a photoluminescent agent has a purity of at least about 90%.

In one alternative implementation, the purity of a photoluminescent agent may be improved before addition to an emissive toner composition. In one example, purity may be improved by recrystallizing the photoluminescent agent. Recrystallization has been found in exemplary photoluminescent agents to provide a high level of stability and increased lightfastness. Not to be bound by any one explanation, one potential explanation for the increased stability is that an exemplary recrystallized photoluminescent agent has an irregular particle shape. Whether obtained by recrystallization or other mechanism, it is believed that an irregularly shaped particle may increase color mixing of multiple color emissive toner compositions (e.g., to provide an improved non-primary emission). In another exemplary aspect, it is believed that an irregularly shaped particle may also decrease cleaning problems associated with cleaning toner particles off of printer components (e.g., printer drum, wiper blade, etc.) that are associated with uniformly spherical particles. In yet another exemplary aspect, it is believed that an irregularly shaped photoluminescent particle increases the surface area of the emissive substance and may increase the amount of light absorbed by the emissive substance for activation of the emission process (e.g., increasing emissive intensity and color). Additionally, recrystallization may increase chemical and/or heat stability of a photoluminescent agent. Such use of irregularly shaped pigment particles is contrary to some accepted practices of toner composition development that prefer uniformly spherical particles for increased toner color and performance.

Various processes for recrystallization are known to those of ordinary skill. In one example, a photoluminescent agent is recrystallized using a solvent (e.g., dimethylformamide (DMF), dimethyl sulfoxide (DMSO), etc.).

Examples of a photoluminescent agent include, but are not limited to, a benzoxazole; a benzothiazole; Phenoxazine [CAS #135-67-1]; Brilliant Sulfoflavine; Solvent Yellow 98 [CAS #12671-74-8]; 2,2-Bipyridine-3,3'-diol; Solvent Yellow 98 [CAS #12671-74-8]; 1,3,6,8-Pyrenetetrasulfonic acid; Coumarin 1; 7-Hydroxycoumarin; 4,4'-Dimethoxybenzil; Chrysene—Purple; Anthracene—Blue; 2,2-(2,5-Thiophenediyl)bis[5-tertbutylbenzoxazole]; $BaMg_2Al_{16}O_{27}$:Eu, Mn; SC-8 Red available from Angstrom Technologies, Inc. of Erlanger, Ky.; 1-(3-Benzothiazol-2-yl-4-hydroxy-phenyl)-3-(3-chloro-phenyl)-urea; ZnS:Cu [CAS #1314-98-3]; $TiO_2$; nigrosene; carbon black; a europium complex, such as a europium complex having CAS #12121-29-8; Europium, tris[4,4,4-trifluoro-1-(2-thienyl)-1,3-butanedionato]bis(triphenylphosphine oxide)—(7CI); GLL300FFS Phosphorescent green available from United Mineral & Chemical Corporation; a visible phosphorescent agent (e.g., PPSB-06 yellow-green phosphor, PPSB-10 turquoise phosphor, PPSB-09 violet phosphor, PPSB-03 orange phosphor, PPSB-23 blue phosphor, PPSB-35 red phosphor, PPSB-16 orange phosphor, PPSB-24 green phosphor, PPSB-26 yellow phosphor, PPZNBB-06 green phosphor, PPWB-10 turquoise phosphor, PPWB-00 blue phosphor, each available from Risk Reactor of Huntington Beach, Calif.); a short-wave green fluorescent powder available by the tradename UVSWG, a short-wave red fluorescent powder available by the tradename UVSWR, and a short-wave blue fluorescent powder available by the tradename UVSWB, each available from LDP, LLC of Calrstadt, N.J.; 2-Methylbenzoxazole, each available from Aldrich Chemical, of Milwaukee, Wis.; Yttrium Vanadate [CAS #7440-62-2]; Oxazine 720 [CAS #62669-60-7], IR 26 [CAS #76871-75-5], IR 140 [CAS #53655-17-7], IR 143 [CAS #54849-65-9], IR 125[CAS #3599-32-4], IR 144 [CAS #54849-69-3], each available from Exciton of Dayton, Ohio; IR fluor SDA6906, IR fluor SDA4927, IR fluor SDA6825, each available from H.W. Sands of Jupiter, Fla.; IRUCR, IRUCG, IRUCG, each available from LDP, LLC of Carlstadt, N.J.; Eosine Y available from Sigma of Milwaukee, Wis. Cresyl Violet and Coumarin 152, each available from Acros of Pittsburgh, Pa.; Rhodamine 640, Stilbene 420, and Nile Blue 690, Exalite 360 [CAS #54849-69-3], Exalite 351, p-Quaterphenyl [CAS #135-70-6], Exalite 377E each available from Exciton of Dayton, Ohio; Lucifer Yellow CH Potassium salt [CAS #71206-95-6] available from Fluka of Milwaukee, Wis.; Pinacryptol Yellow [CAS #25910-85-4] available from Sigma of Milwaukee, Wis.; and any combinations thereof.

In one implementation, a photoluminescent agent includes a benzoxazole. In one example, a photoluminescent agent includes a benzoxazole that does not emit light in the visible spectrum that is detectable by the unaided human eye when irradiated with energy of the visible spectrum and/or an excitation energy. In another example, a photoluminescent agent includes a benzoxazole having a large Stoke's shift (e.g., the higher Stoke's shift the better, such as from about 10 to about 250 nm shift). In still another example, a photoluminescent agent includes a benzoxazole having a large Stoke's shift and that does not emit light in the visible spectrum that is detectable by the unaided human eye when irradiated with energy of the visible spectrum and/or an excitation energy.

In another implementation, a photoluminescent agent includes a benzothiazole. In one example, a photoluminescent agent includes a benzothiazole that does not emit light in the visible spectrum that is detectable by the unaided human eye when irradiated with energy of the visible spectrum and/or an excitation energy. In another example, a photoluminescent agent includes a benzothiazole having a large Stoke's shift (e.g., the higher Stoke's shift the better, such as from about 10 to about 250 nm shift). In still another example, a photoluminescent agent includes a benzothiazole having a large Stoke's shift and that does not emit light in the visible spectrum that is detectable by the unaided human eye when irradiated with energy of the visible spectrum and/or an excitation energy.

In yet another implementation, a photoluminescent agent includes an inorganic chromophore. In one example, an inorganic chromophore is not pre-milled prior to addition to other constituents of a toner composition. Not to be held to any particular theory, it is believed that milling an inorganic chromophore to a smaller size may negatively impact the emissive and/or stability characteristics of the inorganic chromophore. In such an example, to obtain a smaller average particle size of a photoluminescent agent, the photoluminescent agent may be filtered or sieved. Filtering may result in an amount (e.g., a large amount) of photoluminescent agent that does not meet the size requirements of the filtration process. In one example, a photoluminescent agent having a D95 of 80% for 7 microns may have only 5% of the photoluminescent agent that is useable for toner. The large particle size filtered off photoluminescent agent may be recycled for other purposes. An inorganic chromophore may be protected in a toner composition from oxidative damage (e.g., oxidative reaction during the heated process of electrostatic printing) by surrounding the chromophore during the toner composition production process with one or more toner resins as will be understood by those of ordinary skill from the description herein and/or by pre-encapsulation of the chromophore with one or more polymers (e.g., a toner resin, epoxy, hard polymer, etc.) prior to mixing with other toner composition constituents.

In still another implementation, a photoluminescent agent may include a combination of photoluminescent agents. In one example, each photoluminescent agent may have a similar set of one or more emission peaks centered at similar emission wavelengths. In another example, each photoluminescent agent may have a set of one or more emission peaks that have different emission wavelengths. In such an example, the combined emission peaks may combine to provide a desired emissive color in a single toner composition.

A photoluminescent agent may have a variety of particle sizes. In one example of an organic photoluminescent agent, the original size of the photoluminescent agent may be milled to a desired size without loss of emissive activity. In another example, an organic photoluminescent agent may have a size that is a function of the amount of photoluminescent agent encapsulation with toner binder that is desired. If a large amount of encapsulation is desired (e.g., for increasing environmental resistance of photoluminescent agent) the original particle size and/or pre-milled particle size may be smaller. A smaller particle size may increase the likelihood of more extensive encapsulation by toner binder during the toner composition formation process. An inverse consideration includes the increased stability of a toner composition that has been observed with larger particle size. For example, it is believed that increasing photoluminescent agent particle size increases surface area of each particle, but decreases the surface area of the total volume of photoluminescent agent particles. A decrease in overall surface area may decrease the amount of UV (and/or other light energy) striking photoluminescent agent surface to cause loss of emissive luminosity over time. An increase in overall surface area may increase the amount of UV (and/or other light energy) striking photoluminescent agent surface to cause loss of emissive luminosity over time. This is a competing interest, in part, because increased surface area may also increase surface area for emission. In yet another example, an inorganic photoluminescent agent may be more inherently stable to environmental conditions and the largest possible particle size within the constraints of the target toner composition particle size (e.g., D95 less than about 10 microns).

In addition to a photoluminescent agent, an emissive toner composition may also include one or more reflectively visible color pigments. Examples of a reflectively visible color pigment include, but are not limited to, carbon black, titanium dioxide, nigrosene, and any combinations thereof. In one example, a visible color pigment may be utilized to mask a photoluminescent agent that has one or more components that have visible reflectivity in the visible spectral region. In one example, a visibly colored fluorescent material may be used in such a concentration that the visible/reflective color is minimized, while the fluorescence is still noticeable. In another example a small amount of a visible pigment, such as nigrosene, etc. may be used to absorb visible light, while still not itself visible or reflective to the unaided human eye. In still another example, a fluorophore might be used that is reflective and emissive, but used in the context where the background of the substrate to be printed on serves to mask the visible/reflective color.

As discussed above, a photoluminescent agent may itself be reflectively invisible in one example. In another example, a photoluminescent agent may be reflectively visible. A visible reflection attributable to a photoluminescent agent may be masked in a toner composition in a variety of ways. In one example, a visible reflective color of an emissive pigment may be masked with a reflective pigment of the same color. An exemplary toner composition having a photoluminescent agent present in an amount that has a visible reflective green color may be masked by including in the toner composition an amount of a reflective green pigment that masks the presence of the photoluminescent agent.

In yet another example, a separate toner cartridge may be utilized for masking one or more portions of an image component and/or a portion of an emissive toner composition. In one such example, a clear toner that contains only CCA, binder, and other additives (no pigment or other photoluminescent agent) that is non-reflective and non-emissive, can be used to coat all or part of an image to mask a sheen effect (e.g., a sheen effect caused by a reflectively invisible emissive toner composition). In another such example, a separate toner cartridge may include an emissively black toner composition as discussed further below (e.g., $TiO_2$ and/or nigrosene (used in a small concentration of about 0.001 to less than 0.5% w/w) that would serve to absorb all visible light (400-700 nm). In one exemplary aspect, this may increase the effective resolution of an emissive image. In yet another such example, a UV-black composition may be used in a separate toner cartridge to absorb both UV and visible light to increase the effective resolution of an emissive image, but may also slightly decrease the amount of excitation energy absorbed by the fluorophore in the toner. In still another such example, a visibly reflective toner may be printed uniformly over a region of a substrate that may have an emissive image printed thereon. In a further such example, a plurality of visibly reflective toner compositions may be printed as a secondary image in a region of a substrate that may have an emissive image printed thereon.

In a further example, a masking agent may be used directly in each of a plurality of color emissive toner compositions. In one such example, a reflective component of the same reflective color may be added to each of an emissive red (R), emissive green (G), and emissive blue (B) emissive toner compositions that are used together in a multi-color emissive toner system. One possible benefit of such inclusion may include masking of a CCA (or other component of an emissive toner composition) that may be present in an amount that would be reflectively visible. Addition of a reflective component having a visible color that is the same in each toner as the reflectively visible component in any of the toner compositions would provide a visibly reflective uniform print color on the substrate. The existence of a constituent in less than all toner cartridges that is visibly reflective in even a small amount can be masked by such intentional inclusion of a visibly reflective pigment in all toners.

A charge control agent is a substance utilized in a toner composition, at least in part, to stabilize charge of other particles in a toner composition (e.g., by limiting an amount of a charge (positive or negative) that a particle may hold). Charge may be imparted on toner composition particles in a variety of ways. In one example, toner composition particles may obtain a charge due to physical contact with other particles. In another example, a charge may be actively applied to a toner composition particle (e.g., by a mechanism of a printing device).

In one embodiment, a charge control agent includes one or more chemical compounds that do not emit energy in the same spectral region as a corresponding photoluminescent agent of the toner composition. For example, a charge control agent, when printed on a substrate, does not contribute detectible emission in the desired authentication emission spectral region when irradiated with the energy of a desired authentication excitation spectral region. In another example, a charge control agent is combined in an effective amount to control the charge and is selected in combination with a photoluminescent agent and one or more additives in an emissive toner composition such that when printed on a substrate, the charge control agent does not contribute detectible emission (e.g., not contributing dominant emission peaks) in the desired authentication emission spectral region when irradiated with energy of a desired authentication excitation spectral region.

Examples of a charge control agent (e.g., one that does not emit in the visible spectral region when irradiated with energy in the ultraviolet spectral region) include, but are not limited to, a calixerene CCA that does not emit energy in the visible spectral region when irradiated with excitation energy of the UV spectral region, a calixerene CCA that does not emit energy in the UV spectral region when irradiated with excitation energy of the UV spectral region, a modified layered silicate CCA that does not emit energy in the visible spectral region when irradiated with excitation energy of the UV spectral region, a hydrophobically modified metal oxide CCA that does not emit energy in the visible spectral region when irradiated with excitation energy of the UV spectral region, and any combinations thereof. In one example, a CCA includes a calixerene compound that does not emit energy in the visible spectral region when irradiated with excitation energy of the UV spectral region. In another example, a calixerene compound that does not emit energy in the visible spectral region when irradiated with excitation energy of the UV spectral region includes a calixerene compound available as BONTRON E-89 from Orient Chemical of Philadelphia, Pa. In yet another example, a CCA includes a modified layered silicate compound that does not emit energy in the visible spectral region when irradiated with excitation energy of the UV spectral region. In still another example, a modified layered silicate compound that does not emit energy in the visible spectral region when irradiated with excitation energy of the UV spectral region includes a modified layered silicate compound available as N4P from Clariant of Muttenz, Switzerland. In still yet another example, a CCA includes a hydrophobically modified metal oxide compound that does not emit energy in the visible spectral region when irradiated with excitation energy of the UV spectral region. In a further example, a hydrophobically modified metal oxide compound that does not emit energy in the visible spectral region when irradiated with excitation energy of the UV spectral region includes a hydrophobically modified metal oxide compound available as N5P from Clariant of Muttenz, Switzerland.

The amount of CCA in an emissive toner composition may impact one or more desired characteristics of the toner composition when printed on a substrate. A CCA may be present in an emissive toner composition in an amount that is effective to control charge associated with particles of the toner composition. In one exemplary aspect, the selection of a CCA and the amount of the CCA used in an emissive toner composition may depend on the target printing system in which the emissive toner composition is to be used. In one example, a CCA is present in an amount of about 0.1 wt. % to about 10 wt. %. In another example, a CCA is present in an amount of about 3 wt. % to about 7 wt. %. In yet another example, a CCA is present in an amount of about 5 wt. %.

Examples of an additive that may be included in a stable emissive toner composition include, but are not limited to, a toner resin, an encapsulant, a flow control agent, a cleaning agent, a release agent, pigment [e.g., an extra visible pigment], DNA, quantum dots, chemical taggant, and any combinations thereof.

A toner resin is a binding agent that binds the particles of the toner composition and contributes a charge (e.g., a charge that is controlled by the CCA). A toner resin (also known as a binder) may act as a medium to bring together the particles of the toner composition. In one example, a toner resin may act as an encapsulant. In another example, a toner resin also acts to melt upon application of a toner composition and to assist in the binding of a photoluminescent agent to a substrate.

Examples of a toner resin include, but are not limited to, an acrylic copolymer (e.g., a styrene acrylate copolymer, a polypropylene copolymer, an polyethylene copolymer, a polyester copolymer; polyester/acrylate copolymer, polyester/polystyrene/acrylate copolymer,); any combinations thereof Selection of an appropriate toner resin for an emissive toner composition may depend upon a combination of factors. In one example, the printer engine of the target printing device for a toner composition may have a printer heating profile that may have an impact on the selection of a toner resin. A heating profile may be associated with a printer's binding/fusing process and the amount of time for which toner composition particles will be subjected to the heat of binding/fusing. In another example, a toner resin has a melting point, glass transition temperature, and flow rate that are considered in selecting a toner resin (e.g., in relation to a printer heating profile. In another example, heat stability, humidity stability, and/or chemical stability may also factor into the selection of a toner resin. A toner resin should have a melting point, glass transition temperature, and flow rate that are compatible with one or more target printer heating profiles and have a desired high physical and chemical stability. In one example of an analysis of chemical stability, a polyester toner resin may have incompatible chemistry for certain emissive toner compositions. In such a case it may be possible to utilize another toner resin, such as a polystyrene butyl acrylate and/or a polybutyldiene. In another exemplary aspect, a toner resin may be selected that does not have emission when irradiated with light of a visible spectral region and/or an energy utilized for excitation of a selected photoluminescent agent. All are chosen to individually be non-emissive when placed in combination with the other toner composition components.

A toner resin may be present in a toner composition in any amount that depends, in part, on, the weight of the pigment and other contributing materials. In one example, a toner resin is present in an amount of about 40 wt. % to about 95 wt. %. [e.g., with an Iron Oxide can be really low] In another example, a toner resin is present in an amount of about 80 wt. % to about 95 wt. %.

An encapsulant is a material that is used to encapsulate one or more of the constituents of a toner composition prior to mixing together of the constituents to form a toner composition. Examples of an encapsulant include, but are not limited to, melamine formaldehyde, epoxy resins, other polymer, polyethylene (e.g., cryogenically milled) and any combinations thereof.

A flow control agent is a substance that may allow toner particles to move, separate, charge (e.g., may cause charge statically by rubbing against other particles), flow, and/or clean (keeps drum from oxidizing potentially by pieces of flow control agent sticking out of toner cleaning printer components, such as the drum); and may help toner particles charge and stay separated. In one example, a flow control agent may assist in dispersion of a photoluminescent agent and a CCA in a toner composition, modify one or more flow characteristics of a toner resin, modify adhesion of particles within a toner composition, and any combinations thereof. Examples of a flow control agent include, but are not limited to, a silica. In another example, a silica includes an amorphous silica having a CAS # of 68909-20-6.

A flow control agent may be present in a toner composition in any amount that assists with improving flow characteristics of a toner composition. In one example, a flow control agent is present in an amount of about 0.1 wt. % to about 7 wt. %.

A release agent may be utilized to assist with release of toner particles from printer device components, such as a fuser. In one example, a release agent is selected for its ability to facilitate release of toner particles and for not emitting when irradiated with light of a visible spectral region and/or energy utilized for excitation a toner composition. Examples of a wax include, but are not limited to, a copolymer wax, a propylene/ethylene copolymer wax, a paraffin, and any combinations thereof. In one example, a wax includes a propylene/ethylene copolymer wax having a CAS # of 9010-79-1. A release agent may be present in a toner particle releasing effective amount in an emissive toner composition. In one example, a release agent is present in an amount from about 0.1 wt. % to about 5 wt. %.

In one aspect, one or more toner additives should be chosen in combination with a photoluminescent agent and a CCA to provide an emissive toner composition having a desired characteristics (e.g., stability and/or emission spectra) In one example, each toner additive of an emissive toner composition should not emit energy in the desired authentication emission spectral region of the corresponding photoluminescent agent.

In one implementation of a method for formulating an emissive toner composition, a photoluminescent agent is selected that has a high level of purity and natural stability and that has an emission spectra that matches a desired color space (e.g., an emissive primary color, such as Red, Green, Blue). In one example, a photoluminescent agent is selected that when printed on a substrate will provide an image component that is invisible. In such an example, the maximum amount of photoluminescent agent is utilized that can be used in a toner composition such that when printed on a substrate the toner composition provides an image component that is invisible. Maximizing photoluminescent agent concentration may provide a stronger emissive color. However, cost balanced against desired intensity of color and lightfastness may be a factor in selection of the amount of photoluminescent agent used. The amount may also be impacted by color matching of intensities for each emissive toner composition used in a multi-color toner system. The appropriate amount of CCA may be determined by starting with an amount, such as 2 wt. % and balancing the charge requirements of other constituents of the toner composition. A silica flow control agent and wax release agent may be utilized in effective amounts. The toner resin is chosen as discussed above. Each component is selected to be compatible with other constituents and included in an amount effective for each purpose and such that the toner composition has an emission spectra in a desired emission spectral region that includes only the one or more dominant emission peaks corresponding to a wavelength of the one or more emission peaks of the photoluminescent agent. For example, an invisibly emissive effective amount of a photoluminescent agent is an amount that is reflectively invisible in the toner composition and emits in the desired emission spectral region.

In another implementation, an emissive toner composition is an emissively black toner composition. An emissively black toner composition includes a charge control agent and one or more additives, each as described above. The emissively black toner composition may be utilized with one or more emissive color toner compositions in a toner system for printing an image on a substrate, the image having a plurality of image components (e.g., one for an emissively black image component and one for each emissive color image component corresponding to a color emissive toner composition of the system). The emissively black image component, when printed on a substrate, lacks substantial emission in the spectral region utilized for detecting the image component of the one or more emissive color image components when irradiated with an excitation energy used for excitation of one or more of the emissive color image components. In one example, the emissively black image component lacks substantial emission at all of the one or more emissive color image component excitation energies. The emissively black image component can appear as a black color in the emissive color space utilized for viewing an image on a substrate (the black color coming from the lack of emission in that color space. The emissively black color can be attained in a variety of ways. In one example, the emissively black toner composition includes an emissively black agent that absorbs the excitation energy used to excite the one or more emissive color image components. In another example, the emissively black toner composition does not include a photoluminescent agent or other pigment that may emit in the desired emission spectral region. In another example, an emissively black (e.g., UV-black) toner is made by increasing the melting point to allow for less dispersion of the black toner. This may be done by adjusting the co-polymer ratio to make the toner harder and cause it to melt at a higher temperature, i.e. from a normal melting point of around 150° C. to a mp of at least 2° C. higher. In another example, the melting point of an emissively black toner composition is increased to 5-20° C. higher than one or more other colors in a multi-color emissive toner system. In yet another example, a higher melting point emissively black toner composition may be printed before other colors. In still another example, a higher melting point emissively black toner composition may be printed simultaneously with or after other colors.

In another example, a black toner could contain a reflectively visible pigment that is visible or slightly visible when viewed as a raw pigment or raw toner, but becomes invisible when used in combination with a known substrate, such as Teslin (available from PPG Industries). For example, a tan, slightly yellowish toner used in a experimentally determined concentration would be substantially invisible when is masked by the background of the Teslin substrate.

As discussed above, one or more emissive color toner compositions and, optionally, an emissively black toner composition may be utilized in an emissively full-color system for marking a substrate with an image (i.e., an image indicia) having a plurality of image components. Also as discussed above, a variety of full-color models are known including, but not limited to, RGB and CYMK. In one example, a full-color emissive imaging system includes a plurality of emissive color toner compositions (e.g., a C, Y, and M) and/or an emissively black toner composition. In this example, each of the plurality of emissive color toner compositions include a photoluminescent agent as discussed above (e.g., a photoluminescent agent that emits light having one or more emission maxima in a desired emission spectral region when irradiated with an excitation energy. Each emissive color toner composition also includes a CCA and one or more additives as discussed above. Each of the photoluminescent agent, charge control agent, and one or more additives are selected and present in an amount in the corresponding toner composition such that when the toner composition is printed to produce an image component on a substrate, the emission spectra of the image component for irradiation with the excitation energy includes only dominant emission peak corresponding to the dominant emission maxima of the photoluminescent agent.

Figure 4:
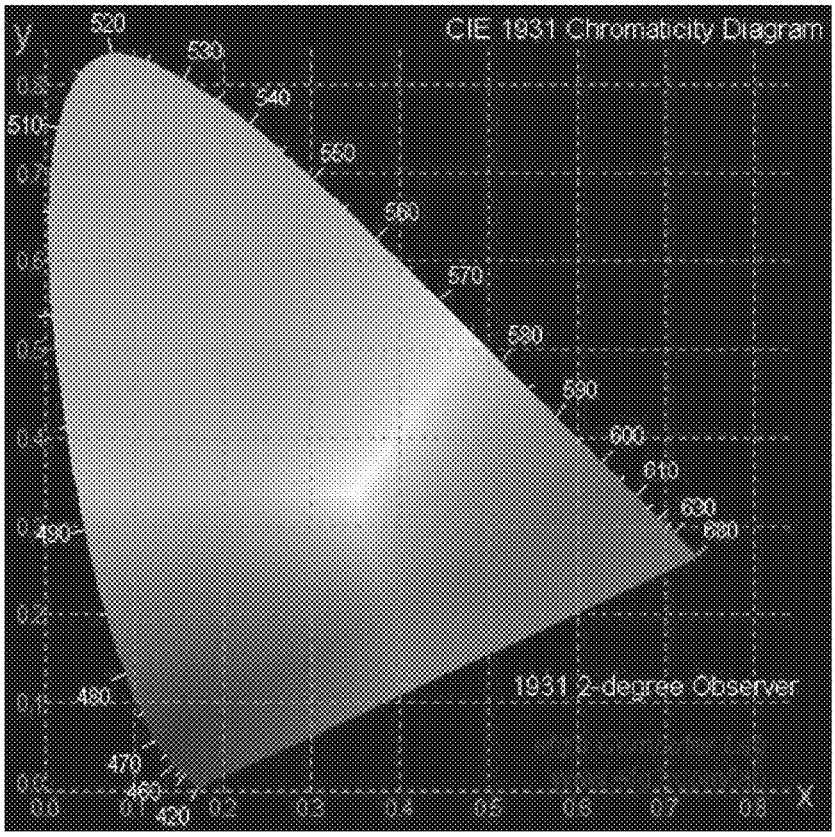
FIG. 4 illustrates one example of diagram of on exemplary full-color visible color space.
Figure 5:
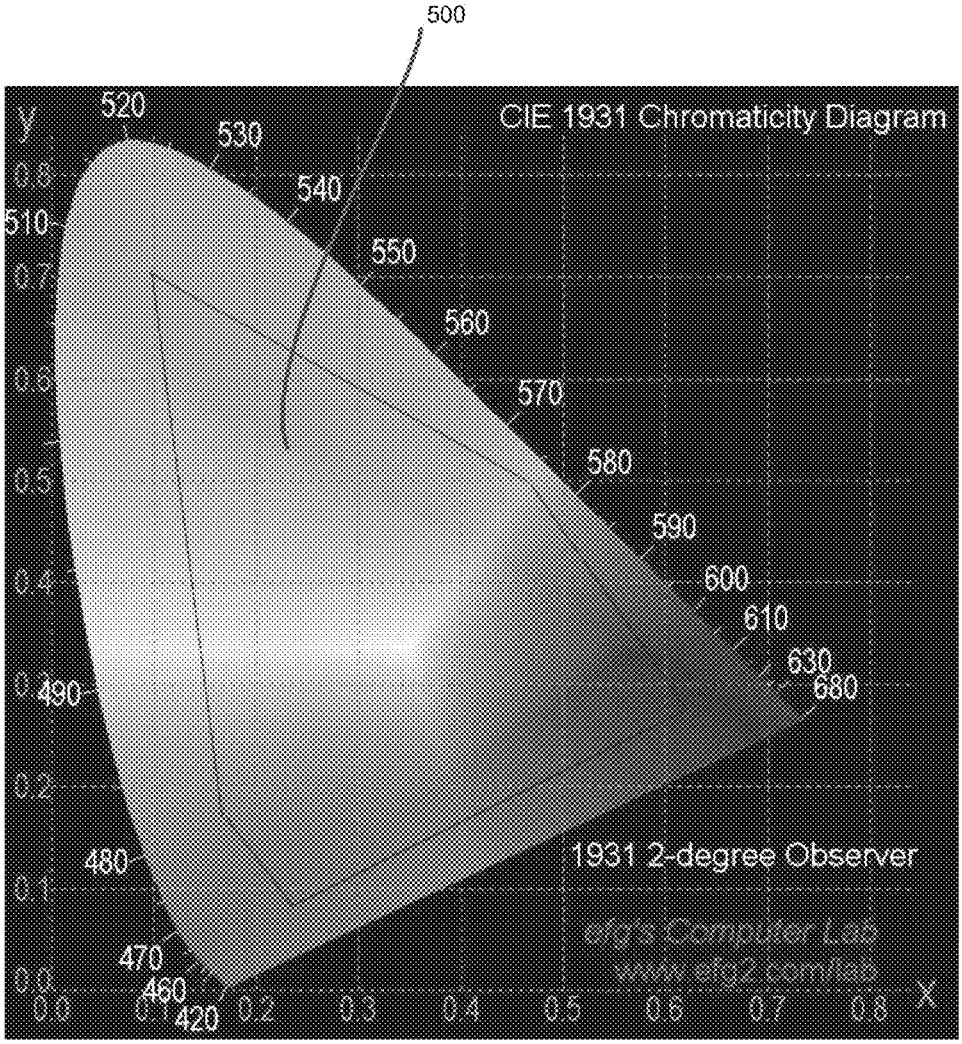
FIG. 5 illustrates one example of a diagram of another exemplary full-color visible color space.

In another example, a full-color emissive toner system is capable of attaining a broad three dimensional color spectra range in the 400 to 700 nm range that is caused by excitation with an excitation energy and emission. In one example, a full-color emissive toner system is capable of attaining the color space of PANTONE PROCESS CYMK. FIG. 4 illustrates an example of a complete color spectra shown by a CIE 1931 chromaticity diagram. This CIE 1931 chromaticity diagram is shown for illustrative purposes of in greyscale. However, one of ordinary skill will recognize that the CIE 1931 chromaticity diagram represents a full-color visible color space that could be attainable by an emissive toner printing system. FIG. 5 illustrates an example of a CIE 1931 chromaticity diagram with a resulting emissive color gamut 500 attainable for emission of a plurality of image components printed on a substrate according to the disclosure herein.

In yet another example, a full-color emissive toner system may have three emissive color toner compositions, each for printing on a substrate a corresponding image component wherein a red image component produced by a first color toner when printed on a substrate has a CIE 1931 chromaticity coordinate in the range defined by about (+/−0.05): (0.48, 0.22) (0.48, 0.43), and (0.67, 0.26); a green image component produced by a second color toner when printed on a substrate has a CIE 1931 chromaticity coordinate in the range defined by about (+/−0.05):(0.14, 0.42), (0.12, 0.72), and (0.43, 0.46); and a blue image component produced by a third color toner when printed on a substrate has a CIE 1931 chromaticity coordinate in the range defined by about (+/−0.05):(0.16, 0.10), (0.15, 0.38), and (0.30, 0.15).

In another example, a full-color emissive toner system having a plurality of emissive color toner compositions and, optionally, an emissively black toner composition may be utilized to print on a substrate a combination of image components that at least in part produce an additive emission when irradiated with one or more excitation energies, the additive emission representing an emissive brown color. Accurate reproduction of a brown emissive color space has been difficult to attain. The improved stability and color purity of the current emissive toner compositions (as will be discussed further below) provide a previously unseen ability to reproduce desired emissive colors on a substrate such that the emissive color of the printed toner composition and/or compositions more accurately represent the target emission spectra of the included photoluminescent agent(s). Such accuracy allows the production of emissive colors in a wide spectrum, including brown emissive color. In one exemplary aspect, an emissive brown color may be important to certain authentication applications (e.g., reproduction of a photograph including various human skin tones in an emissive image for purpose of authenticating a document, such as an identification card). Numerous hues of brown emissive color are potentially attainable using a plurality of emissive color toner compositions. In one example, a combination of image components may produce a brown emissive color having an RGB value of about (55,8,8). In another example, a combination of image components may produce a brown emissive color having a CYMK value of (40, 100, 70, 50). In yet another example, a combination of image components may produce a brown emissive color having a CYMK value of (51, 72, 8, 76). In still another example, a combination of image components may produce a brown emissive color having an RGB value of about (164, 84, 30). In still yet another example, a combination of image components may produce a brown emissive color having an RGB value of about (150, 75, 0).

In one example, an RGB model may be better for the production of brown emissive color. Not being bound to any particular theory, it is believed that because of the additive nature of the RGB model and the existence of red, green, and blue cones in the human eyes, that it is possible that more accurate reproduction of brown emissive color may be possible with an RGB model.

It should be noted that a variety of RGB standard models are available. Examples of RGB models include, but are not limited to, an older International Radio Consultative Committee (CCIR) Standard 601; the International Telecommunications Union standard, Radiocommunications Sector (ITU-R) "Studio encoding parameters of digital television for standard 4:3 and wide screen 16:9 aspect ratios" Standard BT.601; the Electronic Industries Association (EIA) Standard RS-170A; the Video Electronics Standards Association (VESA) Standard 1.2; and any successor standards/versions to these standards and versions.

As discussed above, various procedures for combining image components are contemplated for combining emissive energy from toner compositions that are printed on a substrate to produce a wide range of emissive colors. Examples of such procedures include, but are not limited to, stochastic screening, traditional linescreening, halftoning, dithering, and any combinations thereof. In one example, a first toner composition is printed as an image component to a location on a substrate. A second toner composition is then printed as an image component to the same location on a substrate. These two toner compositions are essentially stacked on top of each other. When irradiated with an appropriate excitation energy the two emissive image components on the substrate emit with their respective emission energies (e.g., each emitting light of a different visible color wavelength). In an additional example, the toner composition of the image component that is stacked on top of the other may be as transmissive as possible (e.g., completely transmissive) to the excitation energy so that the excitation energy can pass to the under image component for excitation. In one exemplary aspect, stacked image components may provide a higher resolution than other combination techniques, such as screening. It should be noted that although these examples illustrate two image components stacked on the same portion of the substrate, it is contemplated that any number of image components may be stacked.

An emissive toner composition may be applied to any substrate. Examples of a substrate for printing an image component thereon include, but are not limited to, a paper substrate, a Teslin substrate, a transfer paper (e.g., transfer to wood, plastic, metal), Tyvek, a plastic, a film (e.g., polymeric film), a transparency, a synthetic paper-like substrate (e.g., polycarbonate sheet, MYLAR), a fabric (e.g., clothing), and any combinations thereof.

As discussed above one example application for an emissive toner composition and/or emissive multi-color toner system is for authenticating a document or other article. The need for improved authentication, for example in the fields of security and product labeling, is continually growing. The emissive toner compositions of the present disclosure provide such an improvement. For example, exemplary emissive toner compositions of the present disclosure are stable, have high color purity, and allow for full-color marking on a substrate that requires marking and/or authentication. Examples of an application for an emissive toner composition include, but are not limited to, authentication, security (e.g., identification documents, licenses, passports), process control (e.g., labeling product packaging), counterfeiting control (e.g., taggant image on clothing, labeling on perfume bottles), artwork, decoration, special effects, taggant for an artist's proof, and any combinations thereof. In one exemplary aspect, an invisible image comprising one or more invisible image components may add to the value of such markings. In one example, product labeling may include an emissive image (e.g., for process control, counterfeiting deterrent) that is invisible, but that emits to disclose the image (e.g., a full-color image). Product packaging is often crowded and aesthetically designed to maximize marketing intentions. Such space and design considerations may not give leave for placement of a visible marking or counterfeit protection tag. In another example, an invisible image that is invisible and emits upon irradiation with UV excitation energy may not be detectible by the unaided human eye. Such an example, like other excitation/emission combinations, requires some form of authentication device (e.g., a UV light source) to view the emissive image. In the case of an authentication device that is in wide use, members of the general public may be able to utilize these types of security features (e.g., the security feature is more of a limited public security feature instead of an overt security feature that everyone can view and a covert security feature that may require highly specialized equipment to view).

Various printing devices (e.g., electrostatic printing devices, such as a photocopier, a laser printer) for printing with one or more reflective toner compositions are known. Any printing device may be utilized with one or more emissive toner compositions and/or emissively black toner composition of the present disclosure to produce an emissive image on a substrate. In one example, a printing device designed for reflective toner compositions may be modified to accept one or more emissive toner compositions. In one such example, data representing an image to be printed may be required to be converted to a negative form prior to being sent to the printing device for printing. For example, an existing CYMK reflective printing system may have its reflective toner replaced by emissive toner compositions of the present disclosure. For an emissive full-color system that is based on an additive RGB model, the cyan reflective toner may be replaced with the emissive red toner, the yellow reflective toner may be replaced with the emissive green toner, and the magenta reflective toner may be replaced by a blue emissive toner composition. The black reflective toner may be replaced by an emissively black toner composition as described herein. In another example, a printing device may be designed originally to utilize emissive toner compositions.

Converting image data to a negative form may be done by software (e.g., software residing in a computer, such as a printer driver designed to utilize emissive toner with a reflective toner printing system). Examples of commercially available computer software that can convert image data to a negative form include, but are not limited to, Adobe® Photoshop® or Adobe® PhotoShop® Elements (both available from Adobe Systems, Inc. of San Jose, Calif.), Corel® Photo-Paint™ (available from Corel Corp. of Ottawa, Ontario, Canada), or ArcSoft® PhotoStudio® (available from ArcSoft, inc. of Fremont, AC), equivalent photo-editing software, and any combinations thereof.

In one embodiment, selection and combination of a photoluminescent agent, a CCA, and one or more additives as discussed herein may produce a toner composition that when printed on a substrate provides an unexpectedly high printed image emissivity stability. The emissivity stability of a printed image and/or a component of the printed image may be measured by any of a variety of indicators of stability. Examples of an indicator of stability include, but are not limited to, emissive lightfastness, general stability from environmental conditions (e.g., heat, humidity, and chemical interactions), color purity, and any combinations thereof. In one exemplary aspect, a toner composition of the present disclosure, when printed on a substrate, exhibits excellent lightfastness. In another exemplary aspect, a toner composition of the present disclosure, when printed on a substrate, exhibits excellent color purity.

Color purity is a term that serves to describe the complex effects of environment on photoluminescent toner. This is a measure of the number of components that contribute to the overall fluorescence of the toner. Each photoluminescent component effects the emission of the toner. The emission qualities of a particular toner are a function of the photoluminescent components and their environment. In one example, the emissive components are limited to only those of the photoluminescent pigment chosen. In another example, the effect of the toner environment on the photoluminescent pigment; and the observed and measured fluorescence of the toner itself may be considered.

Color purity is also very important in respect to the additive effect seen with emissive colors. It is much simpler to derive secondary colors from primary colors by starting with pure primary colors. This is true for both CYMK and RGB color schemes.

Lightfastness is a primary function of the photoluminescent pigment chosen. Lightfastness, or the stability toward light, is a particularly complex subject.

General stability includes stability from heat, humidity and UV light exposure. This is a limiting variable and is primarily a function of the photoluminescent pigment and its environment. While the temperature and chemical stability of a photoluminescent pigment is an important concern; these factors may be more dependent on the environment of the fluorophore in toner and the toner environment can be manipulated to some degree to create a stable formulation. These factors may also include the choice of polymer used, and the effect of the toner additives used, including the CCA.

In one example, emissive stability may be modeled as a photoluminescent toner stability factor (PTSF). A method of quantifying the stability of toner formulations would be a useful tool to measure the long-term stability and determine the suitability of specific toner formulations.

Many concepts may be included in this method including: lightfastness, general stability from heat, humidity, and chemical components. The color purity is also an important concern with emissive colors as the color purity has a demonstrated effect on both observed and measured photoluminescent colors in toner. In one example a photoluminescent toner stability factor (PTSF) measured may be shown as $$PTSF_M = \frac{\text{Lightfastness}}{\text{Color Purity}} \times \text{General stability} * 100,$$

where lightfastness as used herein with respect to $PTSF_M$ is measured as the average loss in luminescence from day 3 to day 7 of an image component of an emissive toner composition on a substrate under xenon-arc exposure at 0.35 $W/m^2$ at 340 nm with sample distanced from light source at 10 inches and a temperature of 50 degrees Celcius (° C.); color purity is the number of photoluminescent component emission peaks having a peak height that exceeds about 5% of the peak height of an emission maximum peak of the spectral region (e.g., quantified by a relative and/or measured intensity of compared peaks in the desired emission spectral region); and general stability is a factor of the average loss of luminescence under heat, humidity and UV light exposure conditions ("QUV exposure conditions"). As used herein the term QUV exposure conditions refers to heat, humidity and UV light exposure conditions using an Atlas UVCON Fluorescent Ultraviolet Condensation Weather Device using a lamp type UVB-313 (or substantially similar device) at an 8 hour light cycle, 4 hour condensation cycle, black panel temperature of 70° C.+−3° C. light cycle and 50° C.+/−3° C. condensation cycle using exposure standards ASTM G 147-02 and/or ASTM G 154-06.

In one example, an emissive toner composition may include a photoluminescent agent, a CCA, and one or more additives, each selected and present in an amount such that when the toner composition is printed to produce an image component on a substrate, the image component has a photoluminescent toner stability factor of about greater than or equal to 25. In another example, an emissive toner composition may include a photoluminescent agent, a CCA, and one or more additives, each selected and present in an amount such that when the toner composition is printed to produce an image component on a substrate, the image component has a photoluminescent toner stability factor of about greater than or equal to 35. In yet another example, an emissive toner composition may include a photoluminescent agent, a CCA, and one or more additives, each selected and present in an amount such that when the toner composition is printed to produce an image component on a substrate, the image component has a photoluminescent toner stability factor of about greater than or equal to 40. In still another example, an emissive toner composition may include a photoluminescent agent, a CCA, and one or more additives, each selected and present in an amount such that when the toner composition is printed to produce an image component on a substrate, the image component has a photoluminescent toner stability factor of about greater than or equal to 48.

EXPERIMENTAL EXAMPLES

Example 1

An Exemplary Emissively Green Toner Composition

An exemplary stable emissive toner composition was prepared including the following components:

| | |
|---|---|
| a styrene acrylate copolymer | 80 to 95 wt. % |
| a propylene/ethylene copolymer wax | 0.1 to 5 wt. % |
| an amorphous silica | 0.1 to 2 wt. % |
| BONTRON E-89 CCA | 5 wt. % |
| SC-4 Photoluminescent Agent | 4 to 8 wt. % |

Method of making: the CCA, photoluminescent agent, styrene acrylate commpolymer, and other additives were dry mixed and ribbon blended (dispersed as uniformly amongst each other). Then the result was fed into an extruder (a device that encompasses heat, pressure, and auger to keep the composition moving for continued distribution and prevention of burning due to heat) through an aperture to create a ribbon. This extrusion was performed at about 250 degrees Celsius, at about 1-4 atmospheres. The ribbon was then broken into chunks and fed through a chipper. The resultant chips were jet milled and classified.

Example 2

Xenon Arc Testing of Prior Art Emissive Toner Composition

A prior art emissive toner composition was prepared including the following components.

| | |
|---|---|
| a styrene acrylate copolymer | 83 to 98 wt. % |
| a propylene/ethylene copolymer wax | 0.1 to 5 wt. % |
| an amorphous silica | 0.1 to 2 wt. % |
| BONTRON E-84 CCA | 5 wt. % |
| SC-4 Photoluminescent Agent | 3 wt. % |

The prior art toner composition was applied to a print area of seven 4 inch by 3 inch Teslin substrates using an Okidata OKI C9600 printer. Each of the seven substrates was exposed to Xenon Arc lamp exposure for differing times over a seven day period such that one substrate was exposed for one day, another substrate exposed for two days, etc. Exposure occurred using a Q-Panel model Q-Sun 1000 having an 1800 Watt (W) xenon-arc lamp with radiometer (control of source) set at 340 nm control point and daylight filter (for eliminating heat). Intensity was set at 0.35 $W/m^2$ at 340 nm with sample distanced from light source at 10 inches and a temperature of 50 degrees Celcius (° C.).

During exposure, half of each substrate was protected from exposure to provide a control. The image component produced by the emissive toner composition on each Teslin substrate was analyzed using a Perkin-Elmer LS 50B Luminescence Spectrometer with 356 nm excitation and emission spectra in the visible spectral region was obtained for the control non-exposed portion and the exposed portion.

Figure 6:
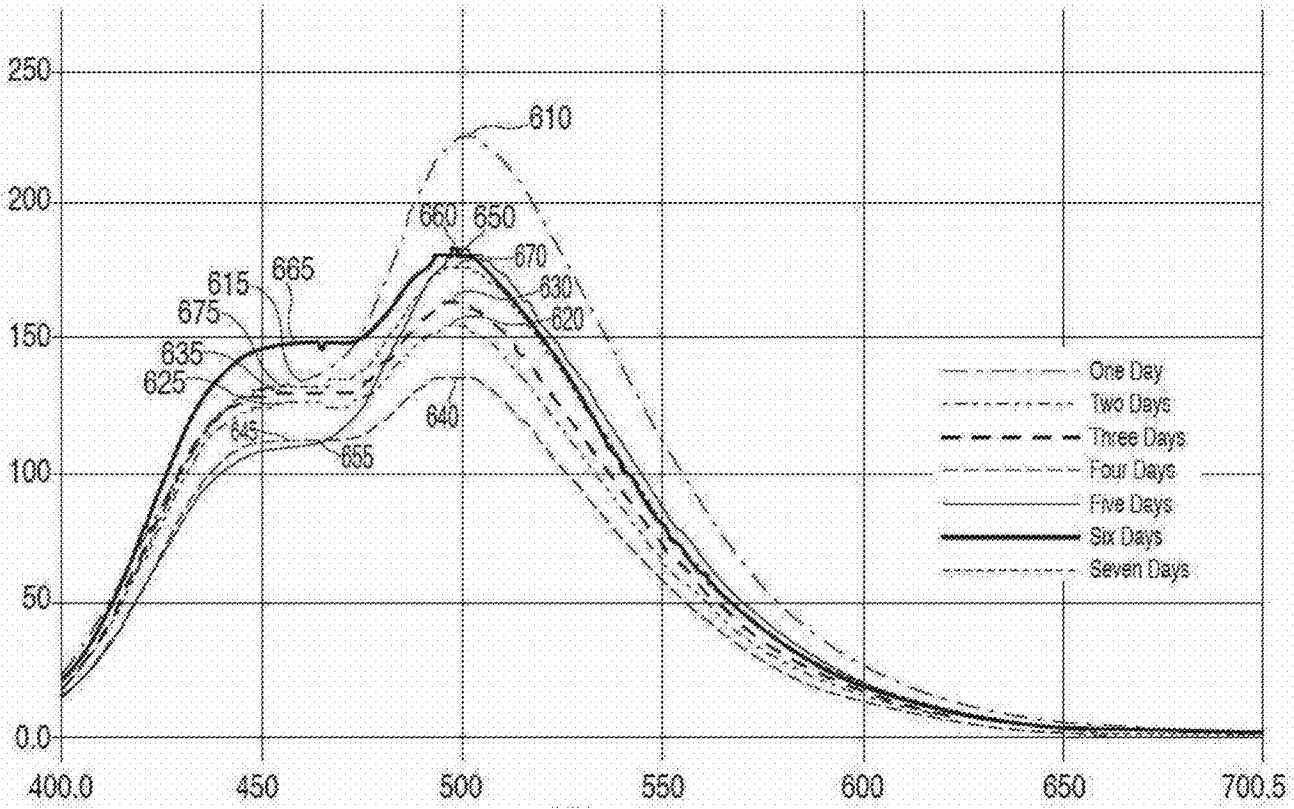
FIG. 6 illustrates exemplary emission spectra for non-exposed portions of an example printed prior art toner composition.

FIG. 6 illustrates emission spectra for the seven Teslin substrate non-exposed portions. The emission spectra at one day includes an emission maximum peak 610 at about 504 nm and another dominant emission peak 615 at about 460 nm that does not correspond to emission due to the photoluminescent agent. The emission spectra at two days includes an emission maximum peak 620 at about 504 nm and another dominant emission peak 625 at about 460 nm that does not correspond to emission due to the photoluminescent agent. The emission spectra at three days includes an emission maximum peak 630 at about 504 nm and another dominant emission peak 635 at about 460 nm that does not correspond to emission due to the photoluminescent agent. The emission spectra at four days includes an emission maximum peak 640 at about 504 nm and another dominant emission peak 645 at about 460 nm that does not correspond to emission due to the photoluminescent agent. The emission spectra at five days includes an emission maximum peak 650 at about 501 nm and another dominant emission peak 655 at about 460 nm that does not correspond to emission due to the photoluminescent agent. The emission spectra at six days includes an emission maximum peak 660 at about 501 nm and another dominant emission peak 665 at about 460 nm that does not correspond to emission due to the photoluminescent agent. The emission spectra at seven days includes an emission maximum peak 670 at about 501 nm and another dominant emission peak 675 at about 460 nm that does not correspond to emission due to the photoluminescent agent. Differences in intensity of emission of each sample that may appear to be inconsistent with the number of days of exposure may be due to differences in print density of toner composition in the image component across samples.

Figure 7:
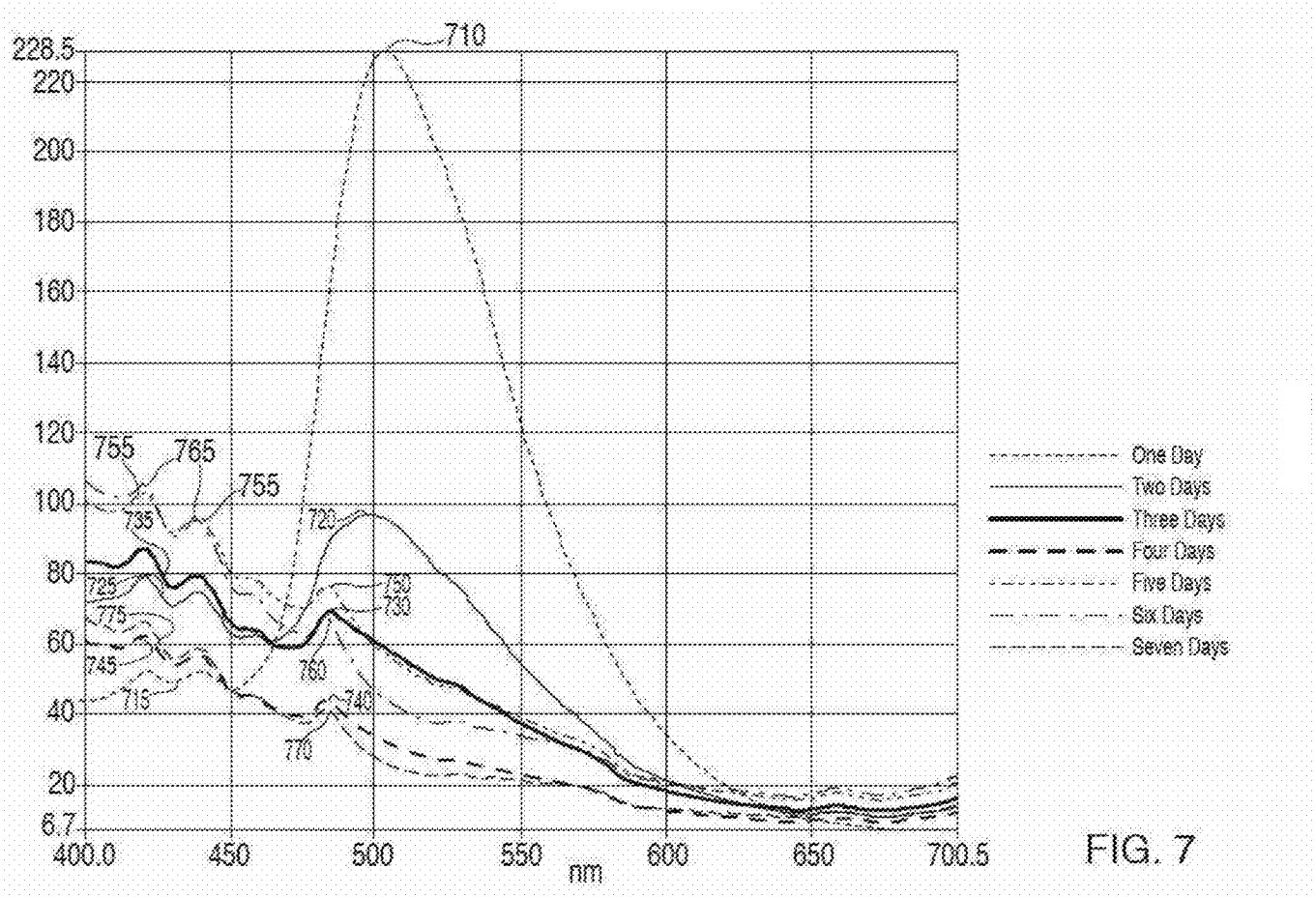
FIG. 7 illustrates exemplary emission spectra for exposed portions of the example printed prior art toner composition of FIG. 6.

FIG. 7 illustrates emission spectra for the seven Teslin substrate exposed portions. The emission spectra at one day includes an emission peak 710 at about 504 nm and a set of degraded peaks 715 in place of the dominant emission peak 615. The degraded peaks do not correspond to emission due to the photoluminescent agent. The emission spectra at two days includes an emission peak 720 at about 504 nm and a set of degraded peaks 725 in place of the dominant emission peak 625. The degraded peaks do not correspond to emission due to the photoluminescent agent. The emission spectra at three through seven days include degraded peaks 730 and 735, 740 and 745, 750 and 755, 760 and 765, and 770 and 775, respectively.

Table 2 below details spectral data for emission at 504.3 nm, which represents the wavelength of peak emission for the emission peak of the target photoluminescent agent of the toner composition. It was observed that the peak emission for this emission peak shifted from about 504 nm to about 501 nm across samples. It was also observed that the non-exposed spectra include a second peak at 460 nm that did not correspond to emission at a wavelength of the photoluminescent agent of the toner composition. The exposed spectra also illustrate the near complete degradation of the emission peak from day 1 to day 7 and the increase of emission at various other wavelengths. Additionally, the peak representing the original emission maximum peak shifted greatly away from 504 nm. Thus, the color stability of the toner composition is unstable across applications and degrades significantly over time and exposure.

TABLE 2

| | | Intensity Before Exposure | Intensity After Exposure | % Degraded |
|---|---|---|---|---|
| 1 day | OT 1-1 | 223.65 | 223.26 | 0.001744 |
| 2 day | OT 1-2 | 150.73 | 95.19 | 0.368473 |
| 3 day | OT 1-3 | 159.36 | 58.13 | 0.635228 |
| 4 day | OT 1-4 | 133.32 | 31.88 | 0.760876 |
| 5 day | OT 1-5 | 180.34 | 56.66 | 0.685816 |
| 6 day | OT 1-6 | 177.85 | 43.65 | 0.754568 |
| 7 day | OT 1-7 | 174.21 | 25.74 | 0.852247 |

Example 3

Xenon Arc Testing of Emissive Toner Composition According to Example 1

An exemplary emissive toner composition was prepared according to the description of Example 1 and was applied to a print area of seven 4 inch by 3 inch Teslin substrates an Okidata OKI C9600 printer. Each of the seven substrates was exposed to Xenon Arc lamp exposure for differing times over a seven day period such that one substrate was exposed for one day, another substrate exposed for two days, etc. Exposure occurred using a Q-Panel model Q-Sun 1000 having an 1800 Watt (W) xenon-arc lamp with radiometer (control of source) set at 340 nm control point and daylight filter (for eliminating heat). Intensity was set at 0.35 $W/m^2$ at 340 nm with sample distanced from light source at 10 inches and a temperature of 50° C.

Figure 8:
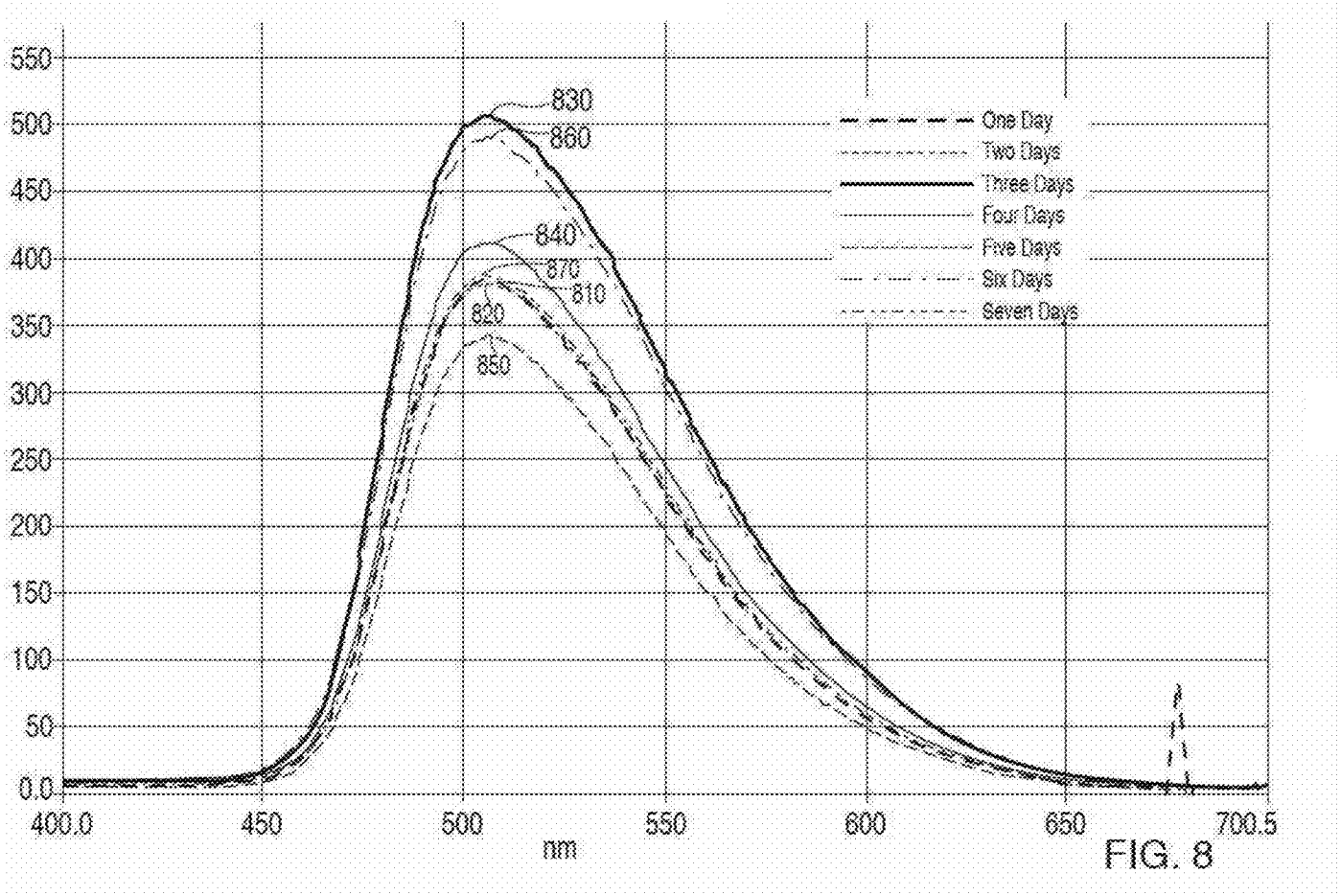
FIG. 8 illustrates exemplary emission spectra for non-exposed portions of one implementation of a stable emissive toner composition printed on a substrate.

During exposure, half of each substrate was protected from exposure to provide a control. The image component produced by the emissive toner composition on each Teslin substrate was analyzed using a Perkin-Elmer LS 50B Luminescence Spectrometer with 356 nm excitation and emission spectra in the visible spectral region was obtained for the control non-exposed portion and the exposed portion. FIG. 8 illustrates emission spectra for the seven Teslin substrate non-exposed portions. The emission spectra at one day illustrates a single emission maximum peak 810 at about 504 nm with no additional dominant emission peaks in the visible spectral region. The emission spectra at two days illustrates a single emission maximum peak 820 at about 504 nm with no additional dominant emission peaks in the visible spectral region. The emission spectra at three days illustrates a single emission maximum peak 830 at about 504 nm with no additional dominant emission peaks in the visible spectral region. The emission spectra at four days illustrates a single emission maximum peak 840 at about 504 nm with no additional dominant emission peaks in the visible spectral region. The emission spectra at five days illustrates a single emission maximum peak 850 at about 504 nm with no additional dominant emission peaks in the visible spectral region. The emission spectra at six days illustrates a single emission maximum peak 860 at about 504 nm with no additional dominant emission peaks in the visible spectral region. The emission spectra at seven days illustrates a single emission maximum peak 870 at about 504 nm with no additional dominant emission peaks in the visible spectral region. Each of these emission maximum peaks correspond to the emission maximum peak of emission for the SC-4 photoluminescent agent. It is noted that there is no shift across samples at zero exposure in the wavelength of the emission maximum peak. Differences in intensity of emission of each sample that may appear to be inconsistent with the number of days of exposure may be due to differences in print density of toner composition in the image component across samples.

Figure 9:
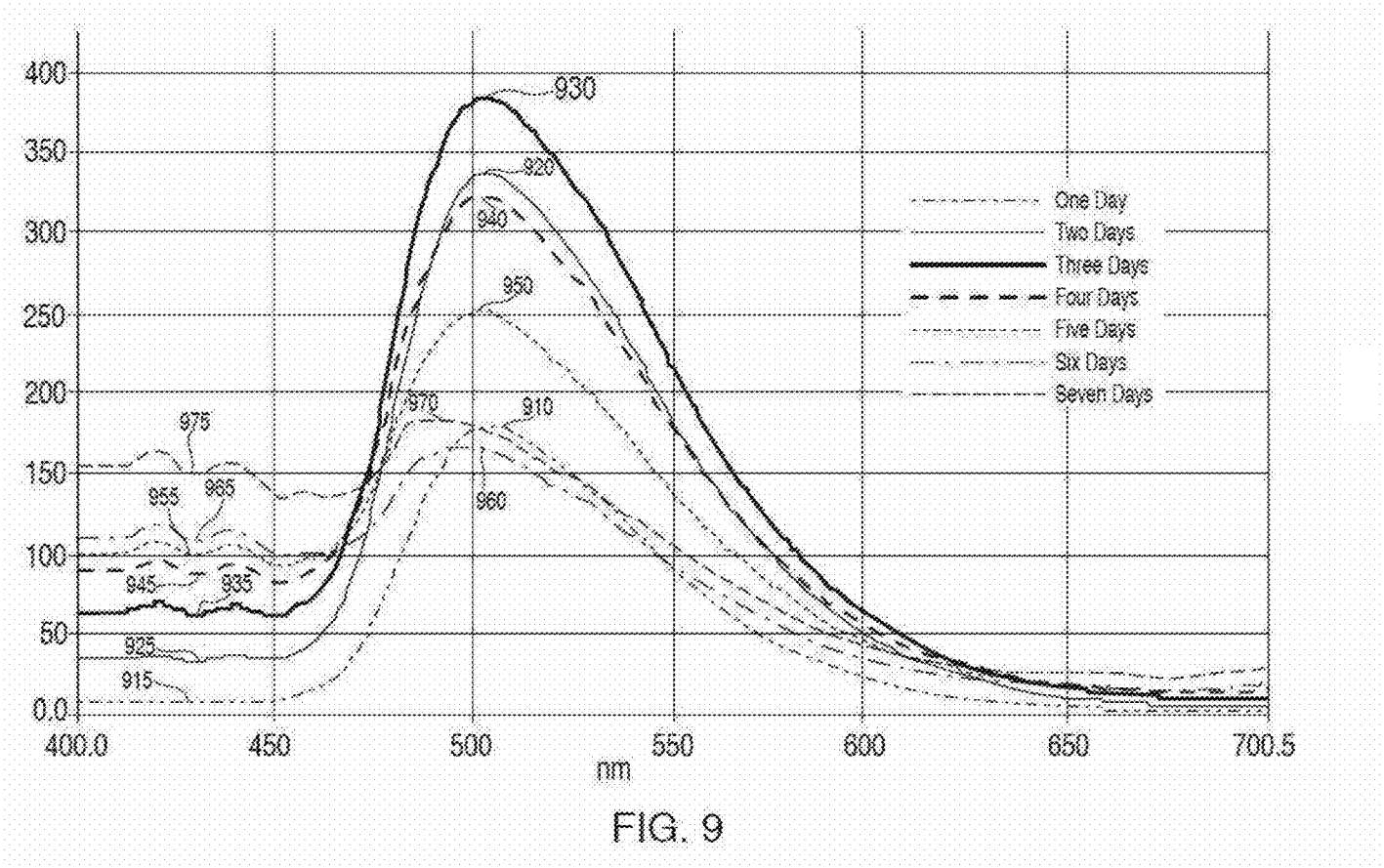
FIG. 9 illustrates exemplary emission spectra for exposed portions of the example printed toner composition of FIG. 8.

FIG. 9 illustrates emission spectra for the seven Teslin substrate exposed portions. Emission spectra for exposed samples after one to seven days illustrate emission maximum peaks 910, 920, 930, 940, 950, 960, 970, respectively. Taking the first day sample as an outlier data point, the emission maximum peak retained a much greater degree of its intensity consistently up to the six and seven day mark. In addition to greater intensity degradation, the emission maximum peak shifted due to exposure below 500 nm. Over time small, emission peaks 925, 935, 945, 955, 965, 975 appear to a much lesser extent than in the prior art sample after two days of exposure.

Table 3 below details spectral data for emission at 504.3 nm, which represents the wavelength of peak emission for the emission peak of the target photoluminescent agent of the toner composition.

TABLE 3

| | Before Exposure | | After Exposure | | |
|---|---|---|---|---|---|
| 1 day | NT 1-1 | 384.21 | NT 1-1 | 179.51 | 0.532782 |
| 2 day | NT 1-2 | 380.89 | NT 1-2 | 337.1 | 0.114968 |
| 3 day | NT 1-3 | 505.97 | NT 1-3 | 383.02 | 0.242999 |
| 4 day | NT 1-4 | 411.12 | NT 1-4 | 322.27 | 0.216117 |
| 5 day | NT 1-5 | 340.59 | NT 1-5 | 250.21 | 0.265363 |
| 6 day | NT 1-6 | 489.58 | NT 1-6 | 164.56 | 0.663875 |
| 7 day | NT 1-7 | 388.16 | NT 1-7 | 176.11 | 0.546295 |

Example 4

Prior Art QUV Testing

Figure 10:
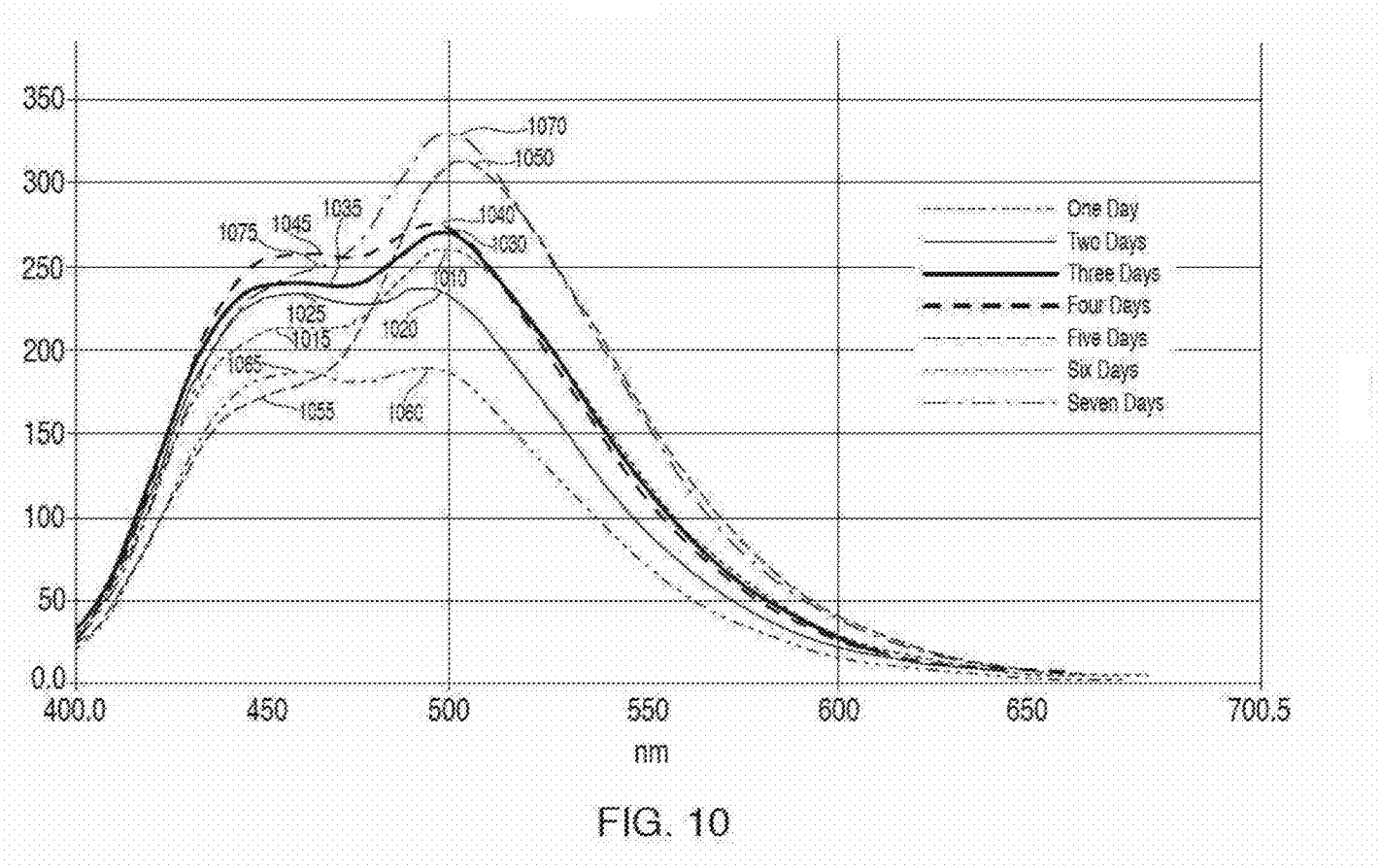
FIG. 10 illustrates exemplary emission spectra for non-exposed portions of another example printed prior art toner composition.

A prior art emissive toner composition according to example 2 above was applied to a print area of seven 4 inch by 3 inch Teslin substrates an Okidata OKI C9600 printer. Each of the seven substrates was exposed to laboratory accelerated weathering for differing times over a seven day period such that one substrate was exposed for one day, another substrate exposed for two days, etc. Accelerated exposure was undertaken using an Atlas UVCON Fluorescent Ultraviolet Condensation Weather Device using a lamp type UVB-313 at an 8 hour light cycle, 4 hour condensation cycle, black panel temperature of 70+−3° C. light cycle and 50+−3° C. condensation cycle. Exposure standards ASTM G 147-02 and ASTM G 154-06 were used. During exposure, half of each substrate was protected from exposure to provide a control. The image component produced by the emissive toner composition on each Teslin substrate was analyzed using a Perkin-Elmer LS 50B Luminescence Spectrometer with 356 nm excitation and emission spectra in the visible spectral region was obtained for the control non-exposed portion and the exposed portion. FIG. 10 illustrates emission spectra for the seven Teslin substrate non-exposed portions. The emission spectra at one day includes an emission maximum peak 1010 at about 504 nm and another dominant emission peak 1015 at about 460 nm that does not correspond to emission due to the photoluminescent agent. The emission spectra at two days includes an emission maximum peak 1020 at about 504 nm and another dominant emission peak 1025 at about 460 nm that does not correspond to emission due to the photoluminescent agent. The emission spectra at three days includes an emission maximum peak 1030 at about 504 nm and another dominant emission peak 1035 at about 460 nm that does not correspond to emission due to the photoluminescent agent. The emission spectra at four days includes an emission maximum peak 1040 at about 504 nm and another dominant emission peak 1045 at about 460 nm that does not correspond to emission due to the photoluminescent agent. The emission spectra at five days includes an emission maximum peak 1050 at about 501 nm and another dominant emission peak 1055 at about 460 nm that does not correspond to emission due to the photoluminescent agent. The emission spectra at six days includes an emission maximum peak 1060 at about 501 nm and another dominant emission peak 1065 at about 460 nm that does not correspond to emission due to the photoluminescent agent. The emission spectra at seven days includes an emission maximum peak 1070 at about 501 nm and another dominant emission peak 1075 at about 460 nm that does not correspond to emission due to the photoluminescent agent.

Differences in intensity of emission of each sample may be due to differences in print density of toner composition in the image component across samples. It is noted that the wavelength of the emission maximum peak shifted across samples to below 500 nm.

Figure 11:
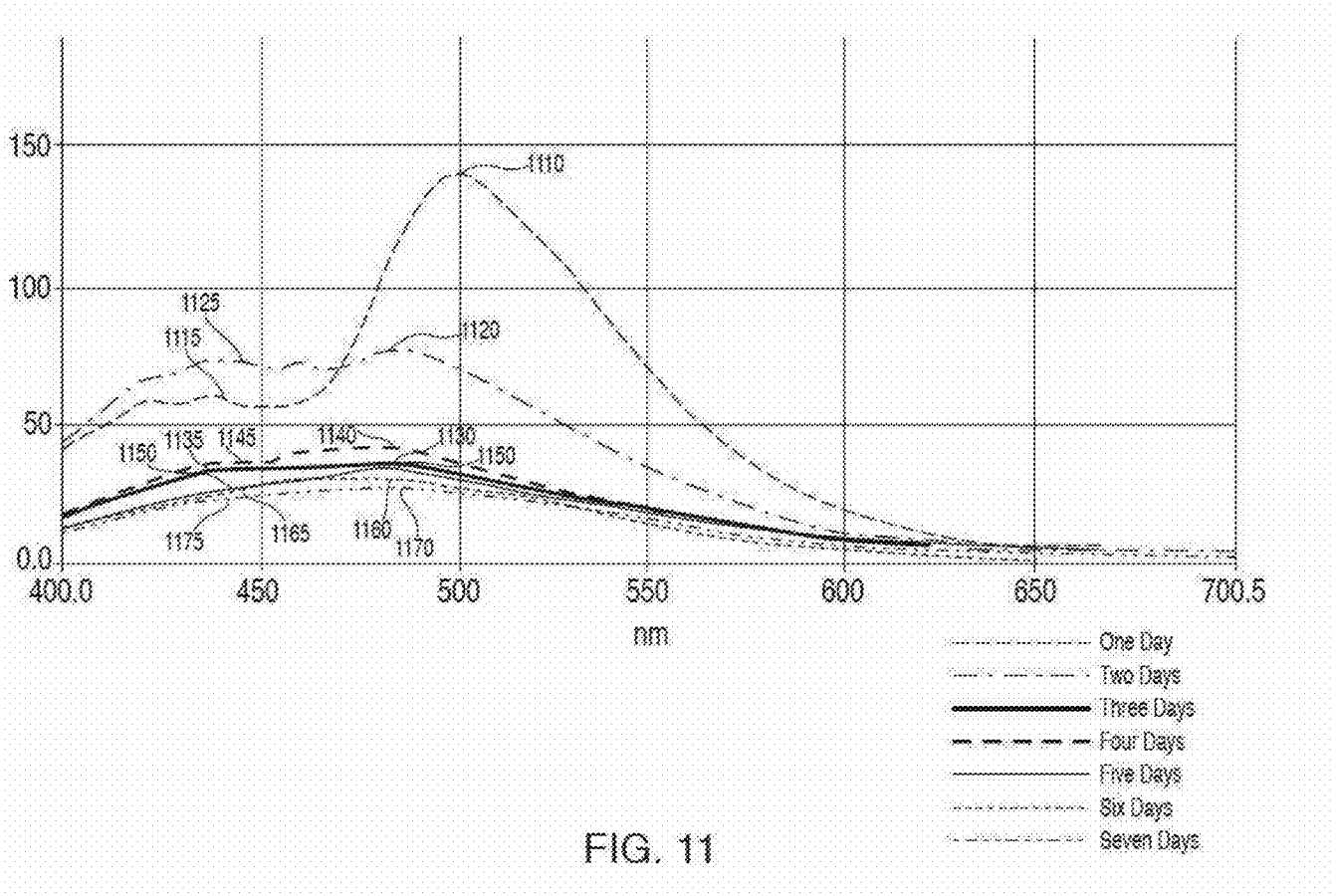
FIG. 11 illustrates exemplary emission spectra for exposed portions of the example printed prior art toner composition of FIG. 10.

FIG. 11 illustrates emission spectra for the seven Teslin substrate exposed portions. The emission spectra at days one to seven each include an emission peak in about the same region as before exposure 1110, 1120, 1130, 1140, 1150, 1160, 1170, respectively. However, it is clear that after one day of exposure, the emission peak due to the photoluminescent agent has shifted to the blue and nearly completely degraded. The emission peaks 1115, 1125, 1135, 1145, 1155, 1165, 1175 that are not due to the photoluminescent agent after one to seven days, respectively, have also degraded significantly. However, peaks 1115, 1125, 1135, 1145, 1155, 1165, 1175 remain in each example as relatively large (i.e., dominant) with respect to corresponding peaks 1110, 1120, 1130, 1140, 1150, 1160, 1170.

Table 4 below details spectral data for emission at 504.3 nm, which represents the wavelength of peak emission for the emission peak of the target photoluminescent agent of the toner composition.

TABLE 4

| | Before Exposure | | After Exposure | | |
|---|---|---|---|---|---|
| 1 day | OT 2-1 | 254.41 | OT 2-1 | 138.34 | 0.456232 |
| 2 day | OT 2-2 | 221.67 | OT 2-2 | 68.82 | 0.689539 |
| 3 day | OT 2-3 | 261.09 | OT 2-3 | 29.87 | 0.885595 |
| 4 day | OT 2-4 | 261.62 | OT 2-4 | 35.33 | 0.864957 |
| 5 day | OT 2-5 | 310.66 | OT 2-5 | 26.66 | 0.914183 |
| 6 day | OT 2-6 | 176.6 | OT 2-6 | 29.53 | 0.832786 |
| 7 day | OT 2-7 | 322.33 | OT 2-7 | 24.74 | 0.923246 |

Example 5

QUV Testing

Figure 12:
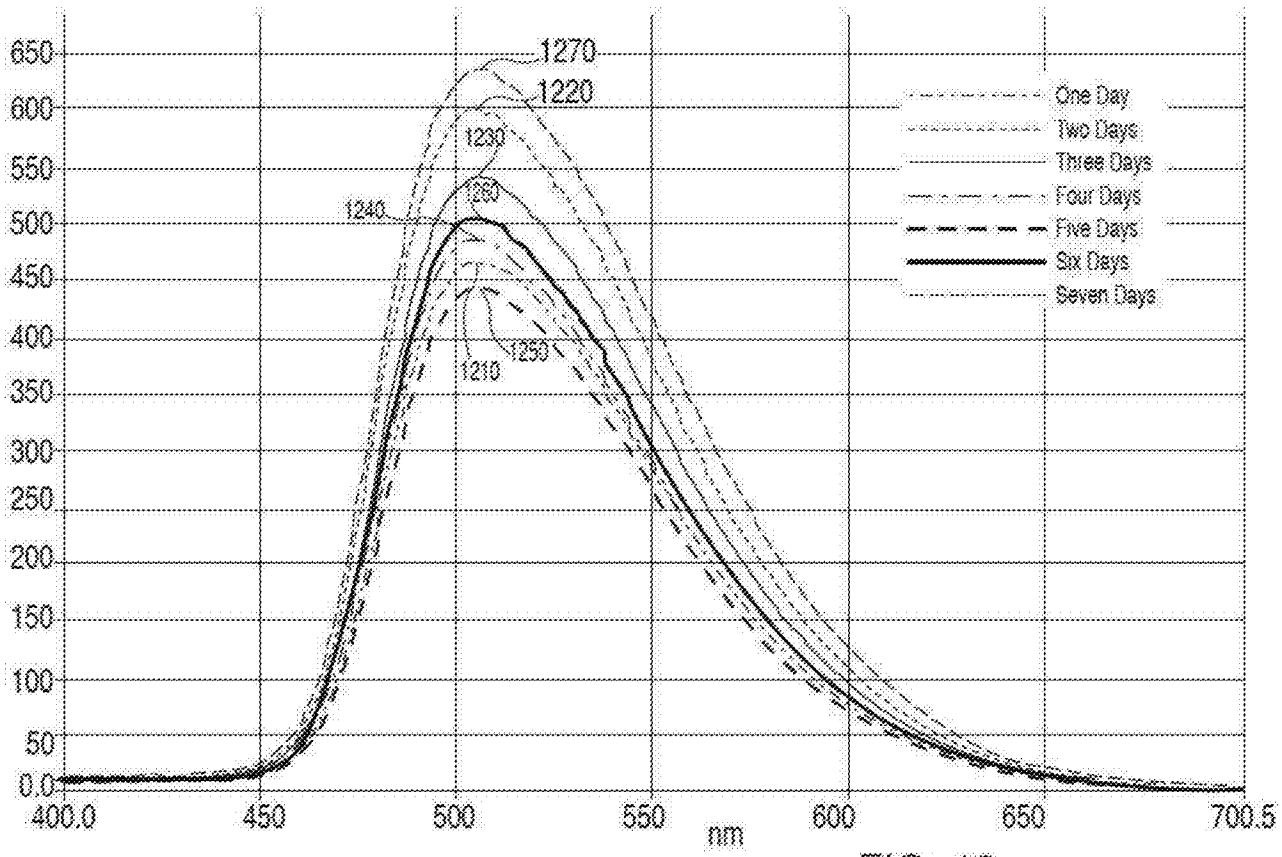
FIG. 12 illustrates exemplary emission spectra for non-exposed portions of another implementation of a stable emissive toner composition printed on a substrate.

An exemplary emissive toner composition was prepared according to the description of Example 1 and was applied to a print area of seven 4 inch by 3 inch Teslin substrates an Okidata OKI C9600 printer. Each of the seven substrates was exposed to QUV exposure for differing times over a seven day period such that one substrate was exposed for one day, another substrate exposed for two days, etc. rate exposed for two days, etc. Accelerated exposure was undertaken using an Atlas UVCON Fluorescent UltraViolet Condensation Weather Device using a lamp type UVB-313 at an 8 hour light cycle, 4 hour condensation cycle, black panel temperature of 70+−3° C. light cycle and 50+−3° C. condensation cycle. Exposure standards ASTM G 147-02 and ASTM G 154-06 were used. During exposure, half of each substrate was protected from exposure to provide a control. The image component produced by the emissive toner composition on each Teslin substrate was analyzed using a Perkin-Elmer LS 50B Luminescence Spectrometer with 356 nm excitation and emission spectra in the visible spectral region was obtained for the control non-exposed portion and the exposed portion. FIG. 12 illustrates emission spectra for the seven Teslin substrate non-exposed portions. The emission spectra at one day illustrates a single emission maximum peak 1210 at about 504 nm with no additional dominant emission peaks in the visible spectral region. The emission spectra at two days illustrates a single emission maximum peak 1220 at about 504 nm with no additional dominant emission peaks in the visible spectral region. The emission spectra at three days illustrates a single emission maximum peak 1230 at about 504 nm with no additional dominant emission peaks in the visible spectral region. The emission spectra at four days illustrates a single emission maximum peak 1240 at about 504 nm with no additional dominant emission peaks in the visible spectral region. The emission spectra at five days illustrates a single emission maximum peak 1250 at about 504 nm with no additional dominant emission peaks in the visible spectral region. The emission spectra at six days illustrates a single emission maximum peak 1260 at about 504 nm with no additional dominant emission peaks in the visible spectral region. The emission spectra at seven days illustrates a single emission maximum peak 1270 at about 504 nm with no additional dominant emission peaks in the visible spectral region. Each of these emission maximum peak correspond to the emission maximum peak of emission for the SC-4 photoluminescent agent. It is noted that there is no shift across samples at zero exposure in the wavelength of the emission maximum peak. Differences in intensity of emission of each sample may be due to differences in print density of toner composition in the image component across samples.

Figure 13:
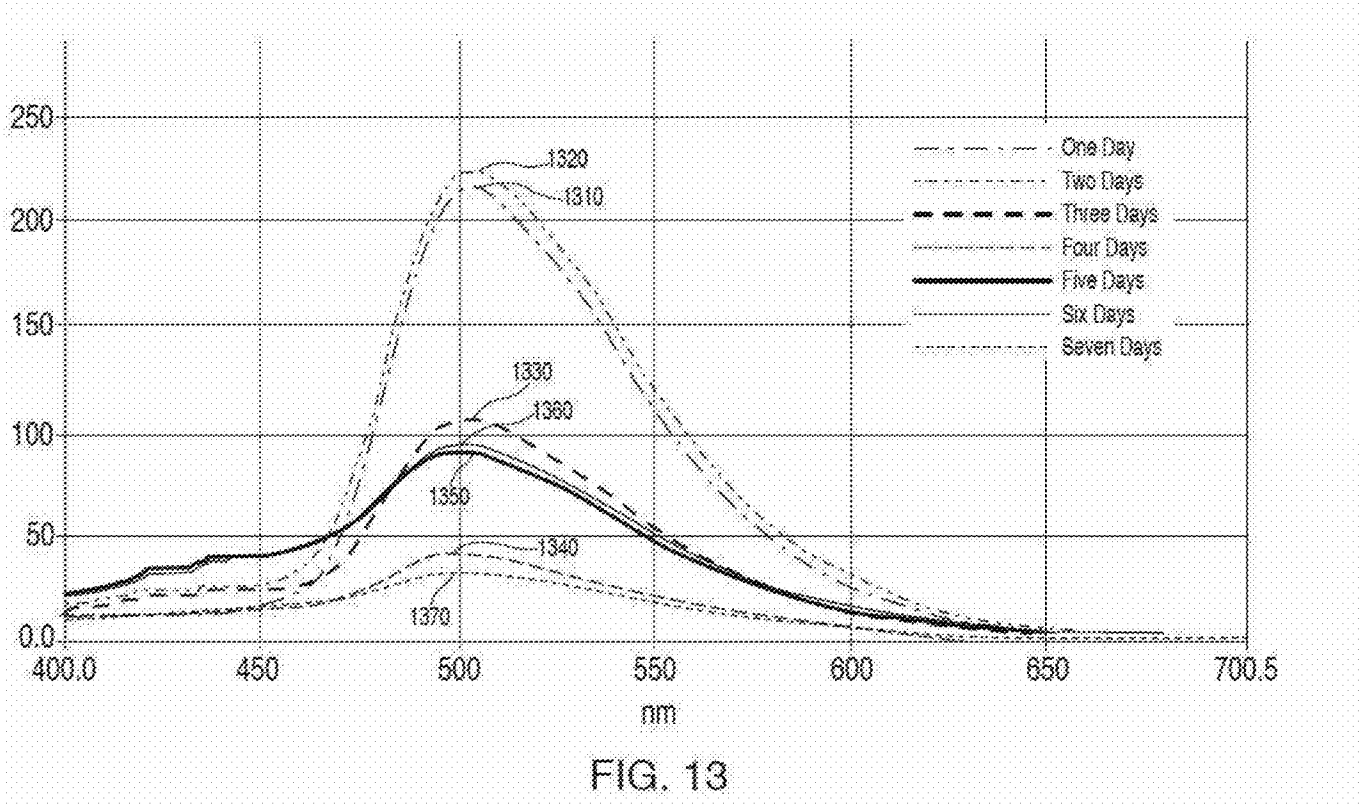
FIG. 13 illustrates exemplary emission spectra for exposed portions of the example printed toner composition of FIG. 12.

FIG. 13 illustrates emission spectra for the seven Teslin substrate exposed portions. Emission spectra for days one to seven illustrate emission maximum peaks 1310, 1320, 1330, 1340, 1350, 1360, 1370, respectively, degrading over time in intensity. However, the color purity remained strong with the emission maximum peak retaining intensity at the wavelength of emission for the photoluminescent agent. Additionally, relative color distortion due to additional emission remained relatively small in each example.

Table 5 below details spectral data for emission at 504.3 nm, which represents the wavelength of peak emission for the emission peak of the target photoluminescent agent of the toner composition.

TABLE 5

| | Before Exposure | | After Exposure | | |
|---|---|---|---|---|---|
| 1 day | NT 2-1 | 466.87 | NT 3-1 | 215.25 | 0.538951 |
| 2 day | NT 2-2 | 600.98 | NT 3-2 | 223.7 | 0.627775 |
| 3 day | NT 2-3 | 540.55 | NT 3-3 | 105.78 | 0.80431 |
| 4 day | NT 2-4 | 485.1 | NT 3-4 | 40.83 | 0.915832 |
| 5 day | NT 2-5 | 441.67 | NT 3-5 | 89.53 | 0.797292 |
| 6 day | NT 2-6 | 503.58 | NT 3-6 | 92.44 | 0.816434 |
| 7 day | NT 2-7 | 634.7 | NT 3-7 | 32.44 | 0.948889 |

Example 7

Three-Dimensional Spectral Analysis/Single Peak

Three-dimensional emissive spectral analysis was conducted using a Horiba Fluoromax 4 Three-Dimensional Scanner. Such a scan provides a spectra that plots measured intensity of energy versus emission wavelength (in nm) versus excitation energy wavelength (in nm).

Figure 14:
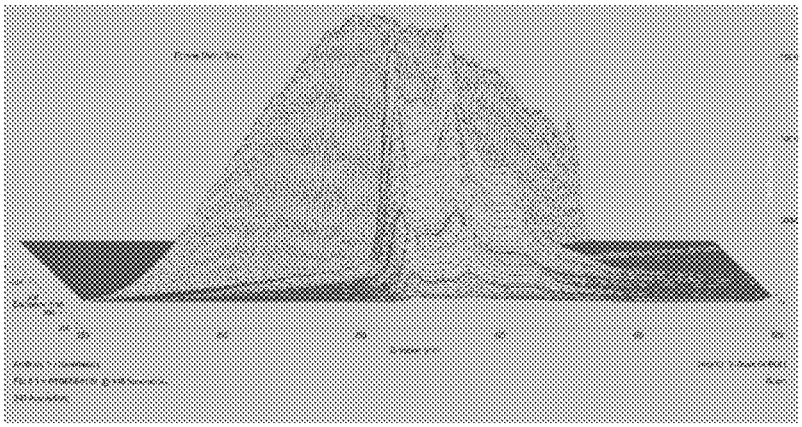
FIG. 14 illustrates one exemplary 3-D spectral scan for pyrene.
Figure 15:
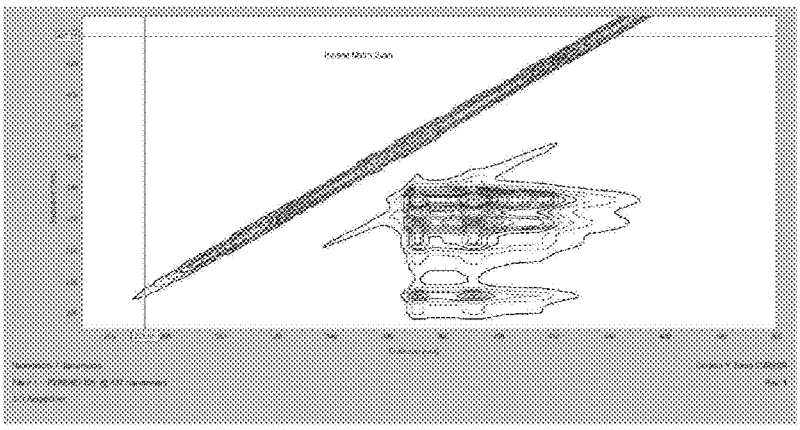
FIG. 15 illustrates another exemplary 3-D spectral scan for pyrene.
Figure 16:
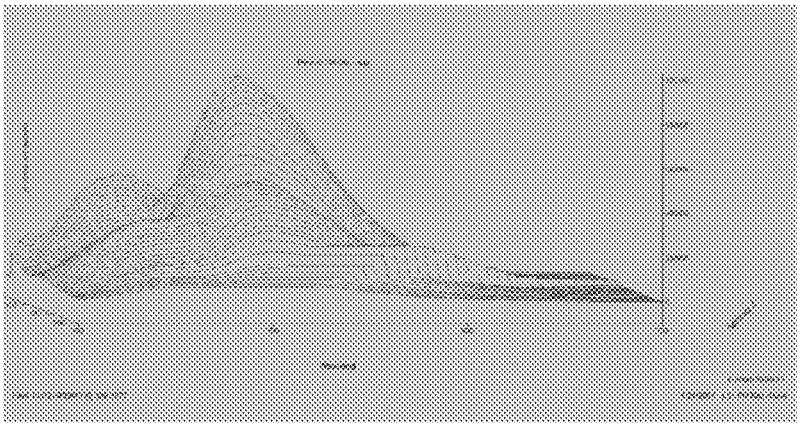
FIG. 16 illustrates one exemplary 3-D spectral scan for an exemplary printed prior art toner composition.
Figure 17:
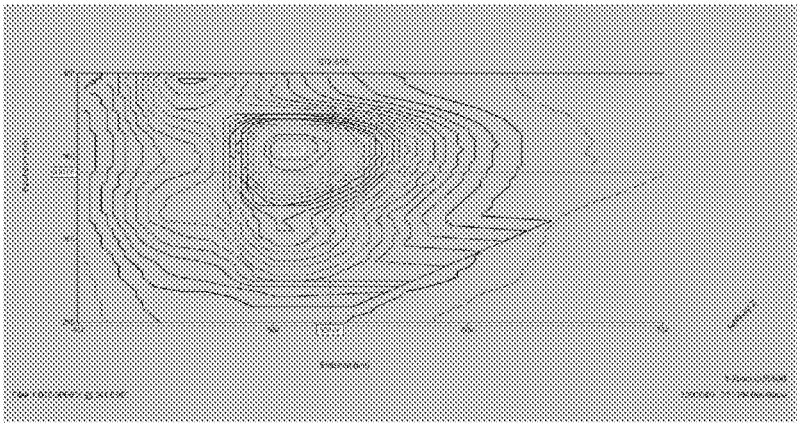
FIG. 17 illustrates another exemplary 3-D spectral scan for an exemplary printed prior art toner composition.
Figure 18:
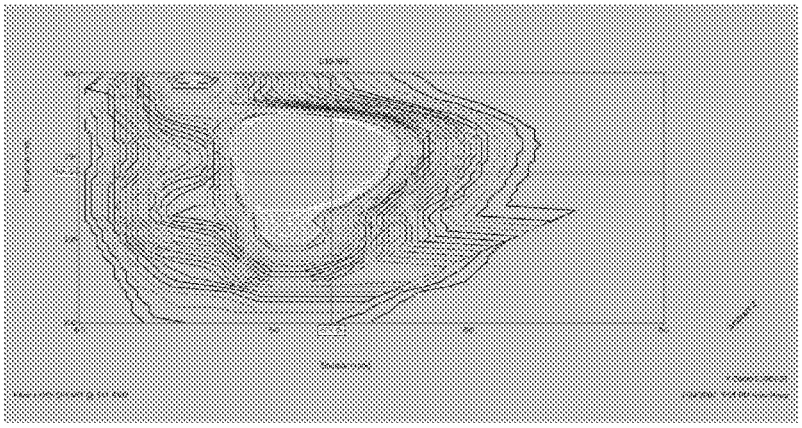
FIG. 18 illustrates yet another exemplary 3-D spectral scan for an exemplary printed prior art toner composition.
Figure 19:
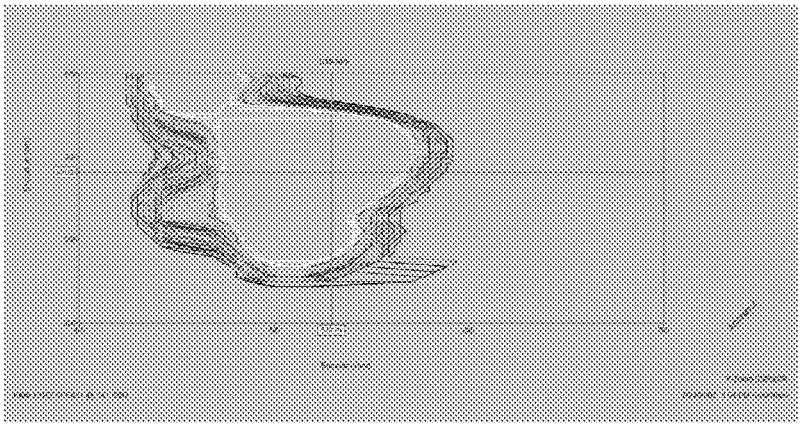
FIG. 19 illustrates still another exemplary 3-D spectral scan for an exemplary printed prior art toner composition.

FIGS. 14 and 15 illustrate exemplary 3-D spectral scans for Pyrene. Pyrene was scanned as a standard to show that overtones and artifacts may exist in an emission spectra. Emission due to fluorescence generates a peak that has a constant excitation wavelength. For fluorescent emission, the wavelength of emission does not change as the wavelength of the excitation energy changes. FIG. 14 shows several emissive peaks in the foreground with an elongated detected peak stretching from about 270 nm of emission to about 460 nm of emission. FIG. 15 illustrates a top view of a scan of Pyrene. This view plots emission wavelength versus excitation wavelength. The elongated peak is shown as varying in emission wavelength as the excitation wavelength changes.

FIGS. 16 to 19 illustrate exemplary 3-D spectral scans for a prior art toner composition according to Example 2 above. FIGS. 16 to 19 show that in addition to the emission maxima that corresponds to the emission of the photoluminescent agent SC-4, there are at least three dominant emission peaks that are not overtones or artifacts.

Figure 20:
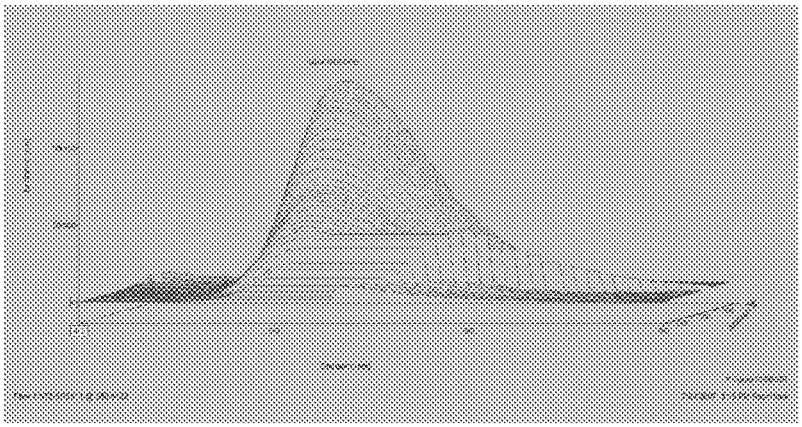
FIG. 20 illustrates one exemplary 3-D spectral scan for an exemplary printed stable emissive toner composition.
Figure 21:
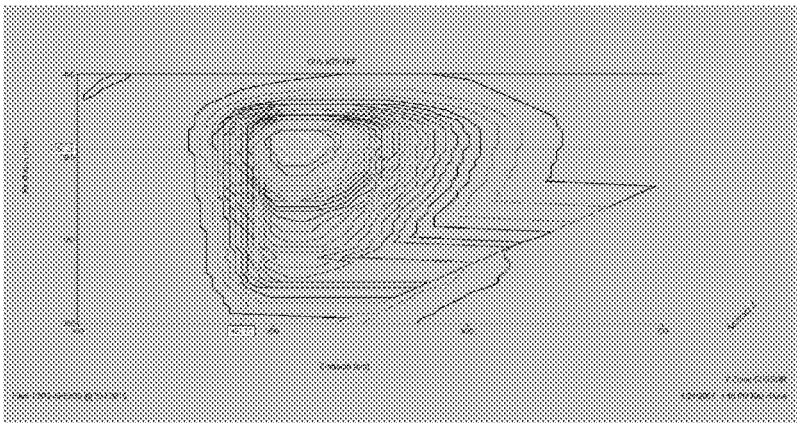
FIG. 21 illustrates another exemplary 3-D spectral scan for an exemplary printed stable emissive toner composition.
Figure 22:
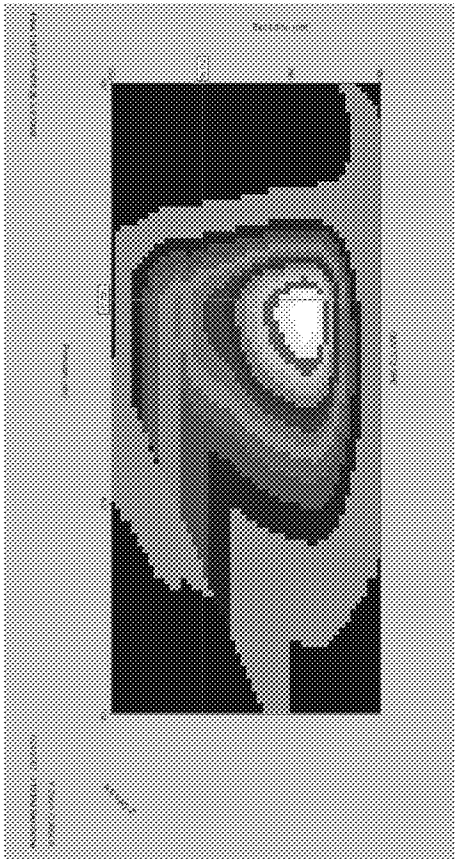
FIG. 22 illustrates yet another exemplary 3-D spectral scan for an exemplary printed stable emissive toner composition.

FIGS. 20 to 22 illustrate exemplary 3-D spectral scans for an example composition according to Example 1 above. The 3-D spectral scans show a single emission peak with no additional dominant emission peaks. The single emission peak corresponds to the emission of the SC-4 photoluminescent agent.

Example 8

PTFS Analysis for Two Examples of SC-4 Containing Toner Compositions

A PTFS was calculated using the data collected above in examples 2 and 4 for a prior art toner composition. The following calculation was made:

$$PTSF=((1-ALF\text{-}XE)\times ALF\text{-}QUV/CP)\times 100=$$

Where

ALF-XE=Average loss in fluorescence from day 3 to day 7 of sample under xenon-arc exposure.

ALF-QUV=Average loss in fluorescence from day 3 to day 7 of sample under QUV exposure.

CP (color purity)=Number of measured dominant photoluminescent peaks in an emissive spectral region (note: taken prior to exposure values)

When CP=2:

$$((1-0.74)\times 0.80/2)\times 100=10.4$$

In an alternative example, CP is taken as 3 or 4 depending on the time used after exposure to count peaks:

When CP=3:

$$((1-0.74)\times 0.80/3)\times 100=6.93$$

When CP=4:

$$((1-0.74)\times 0.80/4)\times 100=5.20$$

A PTFS was calculated using the data collected above in examples 3 and 5 for an emissive toner composition according to example 1. The following calculation was made:

$$PTSF((1-ALF\text{-}XE)\times ALF\text{-}QUV/CP)\times 100=$$

CP=1:

$$((1-0.38)\times 0.78/1)\times 100=48.4$$

Alternatively, an observed PTSF may be calculated using the following formula that does not include color purity:

$$PTSF_O \text{ or } PTSF_V=((1-ALF\text{-}XE)\times ALF\text{-}QUV)\times 100$$

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An emissive toner composition for marking an article with an image indicia for authentication, information, or decoration, the composition comprising:

a photoluminescent agent that emits light having one or more dominant emission peaks in the visible spectrum, each of the one or more dominant emission peaks centered at a corresponding emission wavelength, when irradiated with energy in the ultraviolet spectral region;

a charge control agent that is chemically compatible with the photoluminescent agent and that does not emit light in the visible spectrum when irradiated with visible light and does not emit light in the visible spectrum when irradiated with energy in the ultraviolet spectral region;

one or more additives that are compatible with the photoluminescent agent and the charge control agent and that do not emit light in the visible spectrum when irradiated with visible light and do not emit light in the visible spectrum when irradiated with energy in the ultraviolet spectral region; and the photoluminescent agent, the charge control agent, and the one or more additives forming an emissive toner composition having an emission spectra that includes only dominant emission peaks corresponding to the one or more dominant emission peaks of the photoluminescent agent, as measured in an image component printed on a substrate and irradiated with energy in the ultraviolet spectral region.

2. A toner composition according to claim 1, wherein the one or more dominant emission peaks include only a single dominant emission peak.

3. A toner composition according to claim 1, wherein the photoluminescent agent does not emit light in the visible spectrum when irradiated with visible light.

4. A toner composition according to claim 1, wherein the photoluminescent agent, charge control agent, and one or more additives are selected and present in an amount in the toner composition such that the image component is reflectively visible.

5. A toner composition according to claim 1, wherein the photoluminescent agent, charge control agent, and one or more additives are selected and present in an amount in the toner composition such that the image component is reflectively invisible.

6. A toner composition according to claim 1, wherein said charge control agent includes a charge control agent selected from the group consisting of: a calixarene compound that does not emit light in the visible spectrum when irradiated with visible light and does not emit light in the visible spectrum when irradiated with said energy in the ultraviolet spectral region; a modified layered silicate that does not emit light in the visible spectrum when irradiated with visible light and does not emit light in the visible spectrum when irradiated with energy in the ultraviolet spectral region; a hydrophobically modified metal oxide that does not emit light in the visible spectrum when irradiated with visible light and does not emit light in the visible spectrum when irradiated with energy in the ultraviolet spectral region.

7. A toner composition according to claim 1, wherein the image component has a photoluminescent toner stability factor of about greater than or equal to 25, wherein the photoluminescent toner stability factor is calculated according to the following equation:

$$PTSF=((1-ALF\text{-}XE)\times ALF\text{-}QUV)\times 100,$$

where PTSF is the photoluminescent toner stability factor, ALF-XE is the average loss in photoluminescence of the image component from day 3 to day 7 of a seven day xenon-arc exposure at 0.35 $W/m^2$ at 340 nm with the image component distanced from the xenon arc exposure at 10 inches and a temperature of 50 degrees Celcius, and ALF-QUV is the average loss in photoluminescence of the image component from day 3 to day 7 of submission of the image component to QUV exposure conditions.

8. A toner composition according to claim 7, wherein the image component has a photoluminescent toner stability factor of about greater than or equal to 35.

9. A toner composition according to claim 1, wherein the image component has a photoluminescent toner stability factor of about greater than or equal to 48.

10. An emissive toner composition for marking an article with an image indicia for authentication, information, or decoration, the composition comprising:

a photoluminescent agent that emits light having one or more dominant emission peaks in the visible spectrum, each of the one or more dominant emission peaks centered at a corresponding emission wavelength, when irradiated with energy in the ultraviolet spectral region, the photoluminescent agent not emitting light in the visible spectrum when irradiated with visible light;

a charge control agent that is chemically compatible with the photoluminescent agent and that does not emit light in the visible spectrum when irradiated with visible light and does not emit light in the visible spectrum when irradiated with energy in the ultraviolet spectral region, the charge control agent being present in a charge control effective amount and the charge control effective amount being reflectively invisible;

one or more additives that are compatible with the photoluminescent agent and the charge control agent and that do not emit light in the visible spectrum when irradiated with visible light and do not emit light in visible spectrum when irradiated with energy in the ultraviolet spectral region; and the photoluminescent agent, the charge control agent, and the one or more additives forming an emissive toner composition having an emission spectra that includes only dominant emission peaks corresponding to the one or more dominant emission peaks of the photoluminescent agent, as measured in an image component printed on a substrate and irradiated with energy in the ultraviolet spectral region.

11. A toner composition according to claim 10, wherein the one or more dominant emission peaks include only a single dominant emission peak.

12. A toner composition according to claim 10, wherein the photoluminescent agent, charge control agent, and one or more additives are selected and present in an amount in the toner composition such that the image component is reflectively visible.

13. A toner composition according to claim 10, wherein the photoluminescent agent, charge control agent, and one or more additives are selected and present in an amount in the toner composition such that the image component is reflectively invisible.

14. A toner composition according to claim 10, wherein said charge control agent includes a charge control agent selected from the group consisting of: a calixarene compound that does not emit light in the visible spectrum when irradiated with visible light and does not emit light in the visible spectrum when irradiated with said energy in the ultraviolet spectral region; a modified layered silicate that does not emit light in the visible spectrum when irradiated with visible light and does not emit light in the visible spectrum when irradiated with energy in the ultraviolet spectral region; a hydrophobically modified metal oxide that does not emit light in the visible spectrum when irradiated with visible light and does not emit light in the visible spectrum when irradiated with energy in the ultraviolet spectral region.

15. A toner composition according to claim 10, wherein the image component has a photoluminescent toner stability factor of about greater than or equal to 25, wherein the photoluminescent toner stability factor is calculated according to the following equation:

$$PTSF=((1-ALF\text{-}XE)\times ALF\text{-}QUV)\times 100,$$

where PTSF is the photoluminescent toner stability factor, ALF-XE is the average loss in photoluminescence of the image component from day 3 to day 7 of a seven day xenon-arc exposure at 0.35 $W/m^2$ at 340 nm with the image component distanced from the xenon arc exposure at 10 inches and a temperature of 50 degrees Celcius, and ALF-QUV is the average loss in photoluminescence of the image component from day 3 to day 7 of submission of the image component to QUV exposure conditions.

16. A toner composition according to claim 15, wherein the image component has a photoluminescent toner stability factor of about greater than or equal to 35.

17. A toner composition according to claim 15, wherein the image component has a photoluminescent toner stability factor of about greater than or equal to 40.

18. An emissive toner composition for producing an emissive image component of an image indicia on a substrate, the composition comprising:

a photoluminescent agent that emits light having one or more emission peaks in the visible spectrum, each of said one or more emission peaks centered at a corresponding emission wavelength, when irradiated with energy in the ultraviolet spectral region;

a charge control agent; and one or more additives, said photoluminescent agent, charge control agent, and one or more additives forming a toner composition having an emission spectra that includes only dominant emission peaks in the visible spectrum corresponding to said one or more emission peaks of said photoluminescent agent, as measured in an image component printed on a substrate and irradiated with energy in the ultraviolet spectral region, the image component has a photoluminescent toner stability factor of about greater than or equal to 25, wherein the photoluminescent toner stability factor is calculated according to the following equation:

$$PTSF=((1-ALF\text{-}XE)\times ALF\text{-}QUV)\times 100,$$

where PTSF is the photoluminescent toner stability factor, ALF-XE is the average loss in photoluminescence of said image component from day 3 to day 7 of a seven day xenon-arc exposure at 0.35 $W/m^2$ at 340 nm with said image component distanced from said xenon arc exposure at 10 inches and a temperature of 50 degrees Celsius, ALF-QUV is the average loss in photoluminescence of said image component from day 3 to day 7 of submission of said image component to QUV exposure conditions.

* * * * *